US011208856B2

(12) United States Patent
Young et al.

(10) Patent No.: US 11,208,856 B2
(45) Date of Patent: Dec. 28, 2021

(54) SUBTERRANEAN FORMATION FRACKING AND WELL STACK CONNECTOR

(71) Applicant: Downing Wellhead Equipment, LLC, Oklahoma City, OK (US)

(72) Inventors: Joel H. Young, Oklahoma City, OK (US); Ronnie B. Beason, Oklahoma City, OK (US); Nicholas J. Cannon, Oklahoma City, OK (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 217 days.

(21) Appl. No.: 16/436,623

(22) Filed: Jun. 10, 2019

(65) Prior Publication Data

US 2020/0141196 A1 May 7, 2020

Related U.S. Application Data

(60) Provisional application No. 62/755,170, filed on Nov. 2, 2018.

(51) Int. Cl.
*E21B 19/10* (2006.01)
*E21B 33/04* (2006.01)

(52) U.S. Cl.
CPC ..... *E21B 19/10* (2013.01); *E21B 33/04* (2013.01)

(58) Field of Classification Search
CPC ..... E21B 19/10; E21B 33/04; E21B 23/00; E21B 34/14; E21B 2200/05; E21B 19/16; E21B 19/161; E21B 19/162; E21B 19/168; E21B 33/038; E21B 33/0415; E21B 23/08; E21B 33/068; E21B 33/072
See application file for complete search history.

(56) References Cited

U.S. PATENT DOCUMENTS

| | | | |
|---|---|---|---|
| 3,086,590 | A | 4/1963 | Jackson et al. |
| 3,411,576 | A | 11/1968 | Taylor, Jr. |
| 3,452,815 | A | 7/1969 | Watkins |

(Continued)

FOREIGN PATENT DOCUMENTS

| | | |
|---|---|---|
| CA | 2950732 | 6/2017 |
| GB | 2481949 B | 11/2013 |
| WO | 2017127924 | 8/2017 |

OTHER PUBLICATIONS

PCT International Search Report and Written Opinion in International Application No. PCT/US19/59378 dated Jan. 30, 2020, 9 pages.

(Continued)

*Primary Examiner* — Michael R Wills, III
(74) *Attorney, Agent, or Firm* — Fish & Richardson P.C.

(57) ABSTRACT

A well stack connector has the following features. A drive ring is carried by a housing and is rotatable relative to the housing. A clamp is within the housing. The clamp is moveable between an engaged position and a disengaged position. In the engaged position, the clamp engages the first well device to the second well device. In the disengaged position, the clamp allows the first well device to become unrestrained from the second well device. A linkage is coupled to the drive ring, the housing and the clamp. The linkage is moveable, by rotation of the drive ring, between a first position supporting the clamp in the engaged position and a second position supporting the clamp in the disengaged position.

20 Claims, 14 Drawing Sheets

(56) References Cited

U.S. PATENT DOCUMENTS

| | | | | |
|---|---|---|---|---|
| 3,486,556 | A | 12/1969 | Burgess | |
| 3,874,706 | A | 4/1975 | Arnold | |
| 4,153,278 | A | 5/1979 | Ahlstone | |
| 4,154,298 | A | 5/1979 | Gano | |
| 4,161,367 | A | 7/1979 | Cuiper et al. | |
| 4,162,704 | A | 7/1979 | Gunther | |
| 4,165,891 | A * | 8/1979 | Sullaway | E21B 17/085 285/18 |
| 4,241,786 | A | 12/1980 | Bullen | |
| 4,262,702 | A | 4/1981 | Streich | |
| 4,405,016 | A | 9/1983 | Best | |
| 4,441,742 | A | 4/1984 | Owens, III | |
| 4,474,236 | A | 10/1984 | Kellett | |
| 4,526,406 | A | 7/1985 | Nelson et al. | |
| 4,566,168 | A | 1/1986 | Stromberg | |
| 4,624,483 | A | 11/1986 | Stromberg | |
| 4,646,827 | A | 3/1987 | Cobb | |
| 4,651,830 | A | 3/1987 | Crotwell | |
| 5,020,590 | A | 6/1991 | McLeod | |
| 5,107,931 | A | 4/1992 | Valka | |
| 5,282,655 | A | 2/1994 | Marietta | |
| 5,566,753 | A | 10/1996 | Winkle et al. | |
| 5,575,336 | A | 11/1996 | Morgan | |
| 5,699,822 | A | 12/1997 | Bodhaine | |
| 5,826,610 | A | 10/1998 | Bodhaine | |
| 5,992,526 | A | 11/1999 | Cunningham et al. | |
| 6,062,312 | A | 5/2000 | Willkins | |
| 6,125,939 | A | 10/2000 | Abreo, Jr. | |
| 6,129,149 | A | 10/2000 | Beall | |
| 6,142,233 | A | 11/2000 | Willkins | |
| 6,470,965 | B1 | 10/2002 | Winzer | |
| 6,695,064 | B2 | 2/2004 | Dallas | |
| 6,918,439 | B2 | 7/2005 | Dallas | |
| 6,938,696 | B2 | 9/2005 | Dallas | |
| 7,032,677 | B2 * | 4/2006 | McGuire | E21B 33/038 166/379 |
| 7,163,054 | B2 * | 1/2007 | Adams | E21B 17/085 166/75.13 |
| 7,316,430 | B2 * | 1/2008 | Biester | E21B 33/038 285/394 |
| 8,109,179 | B2 | 2/2012 | Richardson | |
| 8,347,970 | B2 | 1/2013 | Vanderford | |
| 8,474,537 | B2 | 7/2013 | Voss et al. | |
| 8,511,387 | B2 | 8/2013 | Fraser et al. | |
| 8,905,056 | B2 | 12/2014 | Kendrick | |
| 9,127,545 | B2 | 9/2015 | Kajaria et al. | |
| 9,267,335 | B2 * | 2/2016 | Walker | E21B 17/01 |
| 9,534,604 | B2 | 1/2017 | Lopez et al. | |
| 9,644,443 | B1 | 5/2017 | Johansen et al. | |
| 9,670,745 | B1 | 6/2017 | Johansen et al. | |
| 9,765,588 | B2 | 9/2017 | Mansukh et al. | |
| 9,879,496 | B2 | 1/2018 | Johansen et al. | |
| 9,945,216 | B2 | 4/2018 | Ghasripoor et al. | |
| 2003/0168857 | A1 | 9/2003 | Jennings | |
| 2009/0211749 | A1 | 8/2009 | Nguyen et al. | |
| 2010/0139925 | A1 | 6/2010 | McKay et al. | |
| 2010/0218934 | A1 | 9/2010 | Halse | |
| 2011/0025044 | A1 | 2/2011 | McKay | |
| 2012/0222865 | A1 | 9/2012 | Larson et al. | |
| 2013/0093179 | A1 | 4/2013 | Jenkins et al. | |
| 2013/0341539 | A1 | 12/2013 | Hughes et al. | |
| 2014/0144648 | A1 | 5/2014 | McKay | |
| 2014/0290768 | A1 | 10/2014 | Randle et al. | |
| 2014/0352944 | A1 | 12/2014 | Devarajan et al. | |
| 2015/0083430 | A1 | 3/2015 | Jahnke et al. | |
| 2015/0300103 | A1 | 10/2015 | Noordstrand | |
| 2016/0102537 | A1 | 4/2016 | Lopez | |
| 2016/0138352 | A1 | 5/2016 | Leba et al. | |
| 2016/0160889 | A1 | 6/2016 | Hoffman et al. | |
| 2016/0376863 | A1 | 12/2016 | Older et al. | |
| 2017/0067320 | A1 | 3/2017 | Zouhair et al. | |
| 2017/0268306 | A1 | 9/2017 | Kajaria et al. | |
| 2017/0370166 | A1 * | 12/2017 | Angelle | E21B 17/042 |
| 2018/0051527 | A1 | 2/2018 | Scekic et al. | |
| 2018/0209257 | A1 | 7/2018 | Bobadilla Larios et al. | |
| 2018/0284817 | A1 | 10/2018 | Cook et al. | |

OTHER PUBLICATIONS

Evercore ISI "Dear Frac Bears: Efficiency Gains Are Far From Tapped Out—The RigLock Boost To Pressure Pumping EBITDA" Article 3(1)e and 7. May 29, 2018. 15 pages.

PCT International Preliminary Report on Patentability in International Appln. No. PCT/US2019/059378, dated May 14, 2021, 8 pages.

* cited by examiner

SUBTERRANEAN FORMATION FRACKING AND WELL STACK CONNECTOR

CROSS-REFERENCE TO RELATED PATENT APPLICATIONS

This application claims the benefit of priority to U.S. Patent Application No. 62/755,170, filed Nov. 2, 2018, the contents of which are incorporated by reference herein.

TECHNICAL FIELD

The present disclosure relates to fracking and well workover operations.

BACKGROUND

A subterranean formation surrounding a well may be fractured to improve communication of fluids through the formation, for example, to/from the well. The fracturing is often performed in stages, where a segment or interval of the well is fractured, the interval is sealed off, and then a subsequent interval fractured. The intervals are sealed by setting a plug that seals the bore of the well below a certain depth or by shifting a frac sleeve that seals the perimeter of the well from communication with the surrounding formation. The frac sleeves are typically shifted using various sized frac balls, collets or other similar devices dropped from the surface into the well as the fracturing fluid is pumped. The ball, collet or other device lands on a corresponding profile of the sleeve and causes it to shift close. Also, in completion and workover operations, tools are extended into the well under pressure on wireline or coiled tubing to perform various operations, such as perforating the well casing.

SUMMARY

This disclosure describes technologies relating to subterranean formation fracking and well stack connectors.

An example implementation of the subject matter described within this disclosure is a well stack connector for coupling, above a wellhead, a first well device in a well stack and a second well device. The connector has the following features. A drive ring is carried by a housing and is rotatable relative to the housing. A clamp is within the housing. The clamp is moveable between an engaged position and a disengaged position. In the engaged position, the clamp engages the first well device to the second well device. In the disengaged position, the clamp allows the first well device to become unrestrained from the second well device. A linkage is coupled to the drive ring, the housing and the clamp. The linkage is moveable, by rotation of the drive ring, between a first position supporting the clamp in the engaged position and a second position supporting the clamp in the disengaged position.

Aspects of the example implementation, which can be combined with the example implementation alone or in combination, include the following. The clamp includes an attachment end opposite a clamping end. The clamp is a first clamp and the linkage is a first linkage. The connector further includes a second clamp within the housing. The clamp including an attachment end opposite a clamping end. In the engaged position, the clamp engages, by the clamping end, the first well device to the second well device. In the disengaged position, the clamp allows the first well device to become unrestrained from the second well device. A second linkage is coupled to the drive ring, the housing, and the second clamp, the linkage is moveable between a first position supporting the second clamp in the engaged position and a second position supporting the second clamp in the disengaged position. The second linkage is movable between the first position and the second position concurrently with the first linkage by rotating the drive ring.

Aspects of the example implementation, which can be combined with the example implementation alone or in combination, include the following. The linkage includes a first arm, coupled to the housing and the clamp, and a second arm, coupled to the drive ring and proximate to the coupling of the first arm to the clamp.

Aspects of the example implementation, which can be combined with the example implementation alone or in combination, include the following. The second arm is coupled to the first arm proximate to the coupling of the first arm to the clamp.

Aspects of the example implementation, which can be combined with the example implementation alone or in combination, include the following. The first well device, the second well device, and the housing reside on a common center axis, the drive ring is rotatable about the common center axis.

Aspects of the example implementation, which can be combined with the example implementation alone or in combination, include the following. The first well device and the second well device form a male profile when mated together. The clamp includes a female profile shaped to internally receive and clamp the male profile.

Aspects of the example implementation, which can be combined with the example implementation alone or in combination, include the following. An actuator is configured to rotate the drive ring.

Aspects of the example implementation, which can be combined with the example implementation alone or in combination, include the following. Teeth are included on an outer circumference of the drive ring. A rotary actuator includes a gear that engages the teeth.

Aspects of the example implementation, which can be combined with the example implementation alone or in combination, include the following. The housing internally receives the first well device and the second well device. The drive ring protrudes outward from an outer perimeter of the housing.

An example implementation of the subject matter described within this disclosure is a method with the following features. In response to rotating a drive ring of a connector residing above a wellhead, a clamp to is engaged to interface with a first well device in a well stack and a second well device. The first well device clamped to the second well device with the clamp.

Aspects of the example implementation, which can be combined with the example implementation alone or in combination, include the following. Engaging the clamp includes actuating a linkage coupling the drive ring to the clamp. The linkage is arranged to move the clamp radially in response to rotating the drive ring.

Aspects of the example implementation, which can be combined with the example implementation alone or in combination, include the following. The first well device is axially retained to the second well device with the clamp.

Aspects of the example implementation, which can be combined with the example implementation alone or in combination, include the following. The first well device is radially retained to the second well device with the clamp.

Aspects of the example implementation, which can be combined with the example implementation alone or in combination, include the following. Rotating the drive ring includes rotating the drive ring with a geared actuator coupled to the drive ring.

An example implementation of the subject matter described within this disclosure is a well stack with the following features. A valve assembly is above a fracturing head. The valve assembly has two separately actuable valves. A connector is above the valve assembly and is configured to receive a well tool. The connector is actuable to engage the well tool to or disengage the well tool from a remainder of the well string by rotating a drive ring of the connector in response to a signal from an operator.

Aspects of the example implementation, which can be combined with the example implementation alone or in combination, include the following. The connector includes a housing carrying a drive ring. A clamp is within the housing. The clamp includes an attachment end and a clamping end. The clamp is moveable between an engaged position and a disengaged position where in the engaged position the clamp engages, by the clamping end, the well tool, and in the disengaged position the clamp allows the well tool to become unrestrained from the connector. A linkage is coupled to the drive ring, the housing and the clamp. The linkage is moveable between a first position supporting the clamp in the engaged position and a second position supporting the clamp in the disengaged position. The linkage is movable between the first position and the second position by rotating the drive ring.

Aspects of the example implementation, which can be combined with the example implementation alone or in combination, include the following. The linkage includes a first arm, coupled to the housing and the clamp, and a second arm coupled to the drive ring and proximate to the coupling of the first arm to the clamp.

Aspects of the example implementation, which can be combined with the example implementation alone or in combination, include the following. The second arm is coupled to the first arm proximate to the coupling of the first arm to the clamp.

Aspects of the example implementation, which can be combined with the example implementation alone or in combination, include the following. The well tool is at least one of a blowout preventer, a ball or stick launcher, or a wireline lubricator.

Aspects of the example implementation, which can be combined with the example implementation alone or in combination, include the following. The valve assembly includes a body defining a central bore. A first valve is actuable to seal the central bore. A second valve is actuable to seal the central bore. A first passage is between a volume of the center bore above the first valve and the volume of the center bore between the first and second valves. A second passage is between the volume of the center bore between the first and second valves and a volume of the center bore below the second valve.

The details of one or more implementations of the subject matter described in this disclosure are set forth in the accompanying drawings and description. Other features, aspects, and advantages of the subject matter will become apparent from the description, the drawings, and the claims.

DESCRIPTION OF DRAWINGS

FIG. 2A shows the fracturing stack with a blowout preventer (BOP) and lubricator. FIG. 2B shows the fracturing stack in half cross sectional view with the lubricator removed. FIG. 2C shows the fracturing stack with the BOP and lubricator removed.

Like reference numbers in the various drawings indicate like elements.

DETAILED DESCRIPTION

Figure 1:
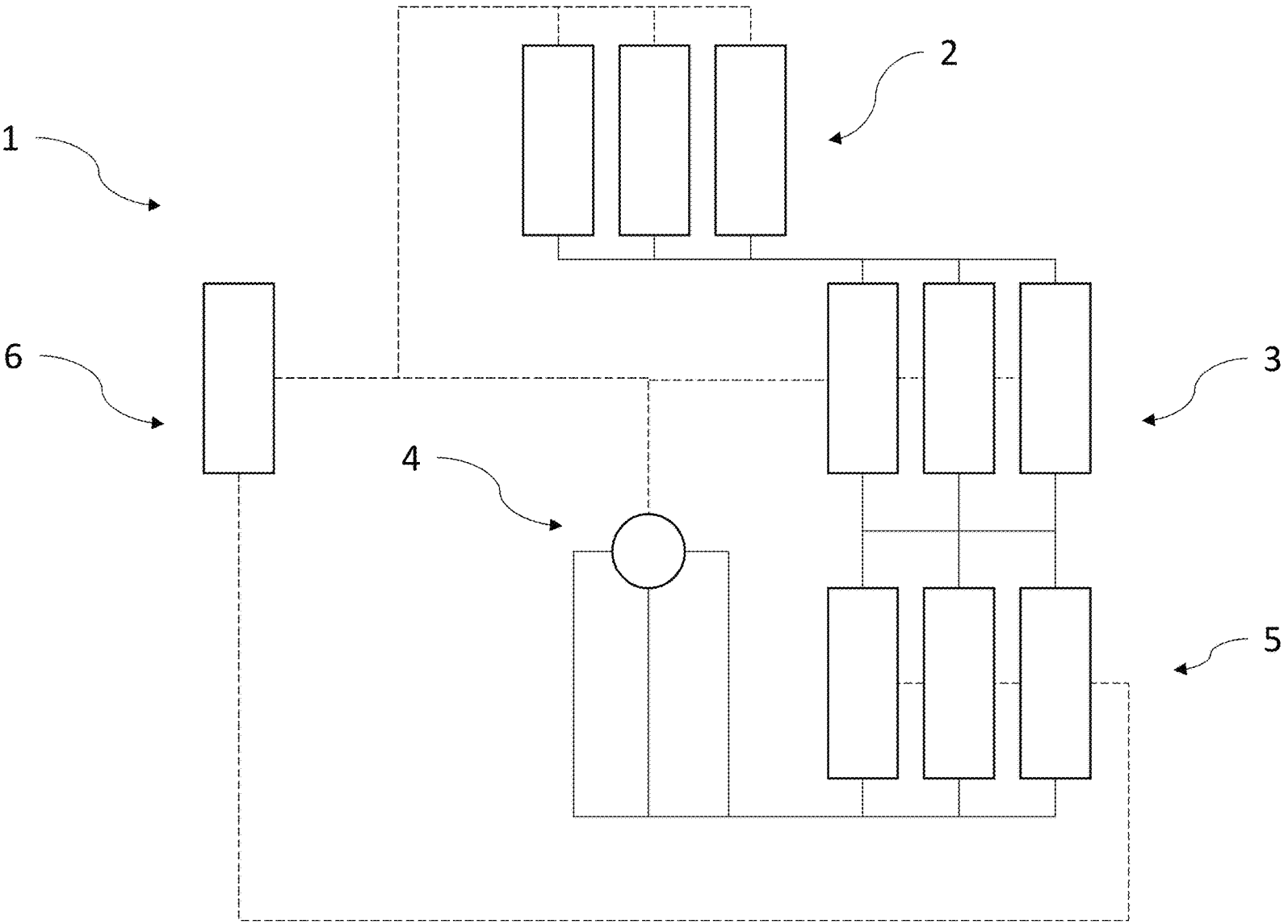
FIG. 1 is a schematic diagram of an example well fracking site.

FIG. 1 is a schematic diagram of an example well site 1 arranged for fracking. The well fracking site 1 includes tanks 2. The tanks 2 hold fracking fluids, proppants, and/or additives that are used during the fracturing process. The tanks 2 are fluidically coupled to one or more blenders 3 at the well site 1 via fluid lines (e.g., pipes, hoses, and/or other types of fluid lines). The blenders mix the fracking fluids, proppants, and/or additives being used for the fracking operation prior to being pumped into the well 4. The blenders are fluidically coupled to one or more fracking pumps 5 via lines. The fracking pumps increase the pressure of the blended fracking fluid to fracking pressure (i.e., the pressure at which the target formation fractures) for injection into the well 4. A data van 6 is electronically connected to the tanks 2, the blenders 3, the well 4, and the fracking pumps 5. The data van 6 includes a controller that controls and monitors the various components at the well site 1. While a variety of components have been described in the example well site 1, not all of the described components need be included. In some implementations, additional equipment may be included. Also, the well 4 can be an onshore or offshore well. In the case of an offshore well, including subsea wells and wells beneath lakebeds or other bodies of water, the well site 1 is on a rig or vessel or may be distributed among several rigs or vessels.

Figure 2B:
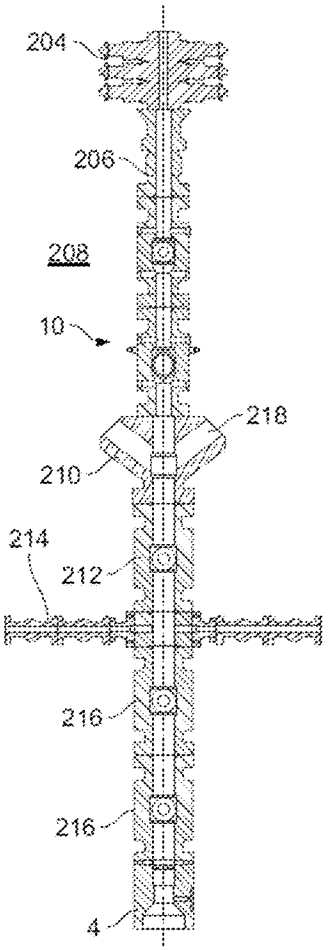
FIGS. 2A-2C are side views of an example fracturing stack that can be used with aspects of this disclosure.
Figure 2A:
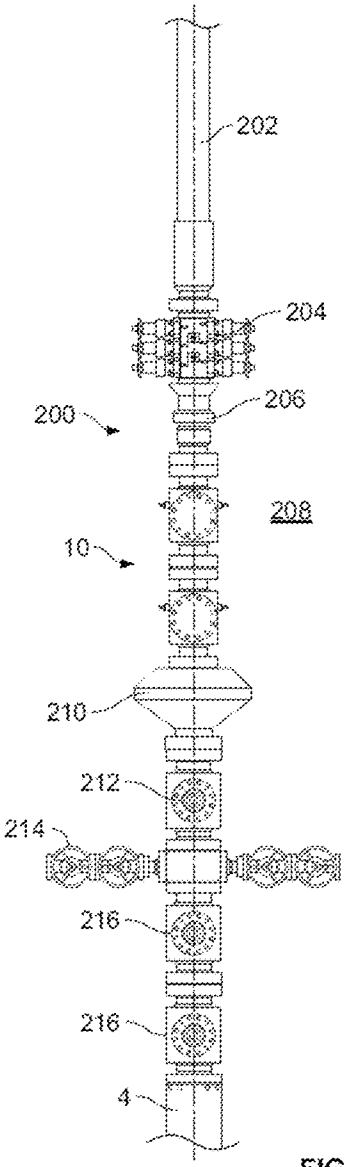
Figure 2C:
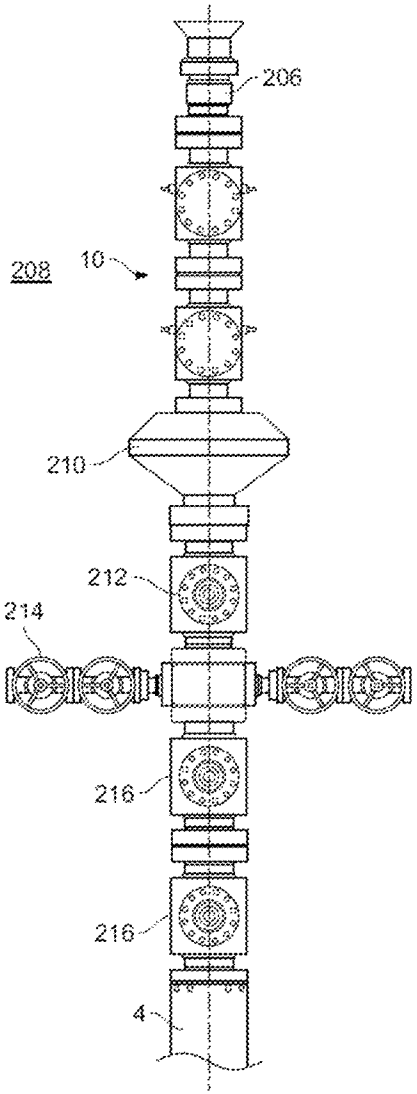

During fracking operations, various components are stacked atop the well 4. FIGS. 2A-2C illustrate, at various stages of operation, an example fracturing stack 200 attached at a wellhead of the well 4. FIG. 2A shows a fracturing stack 200 with a lubricator 202 positioned at the top. The lubricator 202 carries a wireline or coiled tubing deployed tool above a tool trap of or associated with the lubricator. The tool trap has an internal flapper that is actuable in response to a signal (e.g., hydraulic, electric, and/or other signal) to gate passage of the tool from the lubricator. The lubricator is a tool that maintains a seal around the wireline or coiled tubing while the tool is being run into the well 4. In the present example, the lubricator 202 internally carries a perforating string, including one or more perforating guns for perforating the wall of the wellbore (open hole or cased) and, often, a positioning tool, such as a casing collar locator and/or logging tool. In other examples, the lubricator 202 can carry other types of tool strings, such as logging tools, packoff tools, and other types of wireline or tubing deployed tools.

The lubricator 202 sits above a blowout preventer (BOP) 204. The BOP 204 is configured to seal off the well in the event of a kick or blowout. The BOP 204 is able to shear any tool or conveyance (e.g., tubing or wireline) that may be positioned within the well during such an event. An automated connector or latch 206 is below the BOP 204. The latch 206 operates in response to a signal (e.g., hydraulic, electric, and/or other) to grip and seal to (i.e., latch to) or open and release a mating hub. By providing the mating hub on the BOP 204, the latch 206 acts as a quick release that allows the BOP 204 and lubricator 202 to be installed and removed quickly without intervention of a worker, for example, to access and bolt/unbolt the BOP 204 from the remainder of the fracturing stack 200. In some instances, the latch 206 can be omitted from the fracturing stack 200 and the BOP bolted/unbolted from the remainder of the stack. The latch 206 can be above a valve assembly 10.

A valve assembly 10 is below the latch 206. The valve assembly 10 can include a single or dual part body. The valve assembly 10 is actuable in response to a signal (e.g., hydraulic, electric and/or other) to isolate or seal the well (i.e., seal the bore through the fracturing stack 200) from any components positioned above the valve assembly 10, such as the lubricator 202, BOP 204, or the atmosphere 208. Structural details of the valve assembly 10 are described in greater detail later within this disclosure. Below the valve assembly 10 is a fracturing manifold 210, sometimes referred to as a goat head or frac head. The fracking pumps 5 are fluidically connected by lines to the fracturing stack 200 through the frac head 210. In certain instances, a swab valve 212 can be provided above or below the frac head 210 that can be used to isolate/access the well, for example for maintenance. Below the swab valve 212 are wing valves 214. The wing valves 214 can be used for a variety of wellbore operations, such as purging the well 4. Below the wing valves are one or more main valves 216 configured to seal the well 4, including as the fracturing stack 200 is assembled, disassembled, and/or maintained. While a variety of components have been described in the fracturing stack, not all of the described components need be included. In some implementations, additional equipment, such as additional main valves 216, may be included. Also, although shown as separate components, two or more of the components of the fracturing stack 200 could be integrated. For example, in certain instances, the frac head 210 and valve assembly 10 may be integrated together, e.g., constructed with a common housing or otherwise configured to attach/detach from the fracturing stack 200 as a unit. Other combinations of components could likewise be integrated.

The valve assembly 10, when closed, seals to maintain pressure on and below the frac head 210 and any equipment fluidically connected to the frac head 210, for example the fracking equipment at the well site 1, including pumps 5, the blenders 3, and any lines fluidically connecting such equipment. Such isolation allows the BOP 204 and lubricator 202 to be removed, reinstalled, or maintained without depressurizing the well 4 or fracturing equipment on the well site 1. As explained in more detail below, such isolation also allows the top of the fracturing stack 200 to be opened and accessed at atmospheric conditions, for example, to insert a tool on wireline or tubing or a well drop (e.g., frac ball, collet, dart, or other) or other item into the well 4. Every time the fracturing stack 200 and fracturing equipment at the well site 1 is depressurized, it needs to be re-pressure tested prior to commencing operations. In some instances, this can take several hours, and in multi-stage fracturing, cumulatively days. In multi-stage fracturing operations, where equipment is added and removed from the top of the fracturing stack 200 multiple times, maintaining pressure on the system between operations can save several days at a well site.

FIG. 2B shows a cross-sectional view of the fracturing stack 200. Once assembled, the fracturing stack has a central flow path, or main bore, extending through the center of the stack. The frac head 210 includes lateral fluid injection paths 218 where the fracking pumps 5 are fluidically connected for injecting frac fluids into the main bore and, in turn, into the well 4 during a fracturing treatment. The valve assembly 10 sits above the frac head 210 and includes two valves capable of sealing, i.e., isolating, the frac head 210 and fracturing stack 200 below from any equipment located above the valve assembly 10. For example, fracturing stack 200 can be pressurized and leak tested for perforation operations. In such a situation, the BOP 204 and lubricator 202 are installed to lower the perforating string into the wellbore. After the perforation operation is complete, a frac ball can be dropped into the well. In such an instance, the valve assembly 10 is closed and all of the components above the valve assembly are depressurized. In some instances, the BOP may remain in place. In other instances, the BOP can be removed, such as in FIG. 2C. In either instance, the fracturing stack 200 is still pressurized below the valve assembly 10.

After the well 4 is completed, or in a workover operation of the well 4, the fracturing stack 200 is used in fracturing the subterranean formation surrounding the well 4. While more details of the operation of the fracturing stack 200 will be described below, in general, in a fracturing operation, fracturing fluids containing proppant are pumped to the frac head 210 from the blenders 3 and pumps 5 at the well site 1. The fracturing stack 200 can be in either configuration of FIG. 2A or 2C and valve assembly 10 is closed, sealing the central bore of the fracturing stack 200 above the fracturing head 210. The fracturing fluids pass into the frac head 210, down the central bore of the fracturing stack 200 and the well 4, and out of a perforated or slotted interval of the well 4 into the subterranean formation. The fracturing fluids are at fracturing pressure, meaning the rate and pressure of the fracturing fluids are so high as to cause the subterranean formation at that interval to expand and fracture.

In a multi-stage fracturing operation, the well 4 is perforated and then fracked in another interval. A lubricator 202 containing a perforating string is used in conducting the perforating operation. If, upon completion of the first stage fracturing, the fracturing stack 200 is configured as in FIG. 2C without a lubricator 202, the latch 206 is operated to receive the BOP 204 with the lubricator 202 as shown in FIG. 2A. The valve assembly 10 is then used (as discussed in more detail below) to bring the BOP 204 and lubricator 202 up to pressure without needing to lower the pressure in the fracturing stack 200 below the fracturing head 210. The perforating string can then be lowered through the valve assembly 10 into the well 4, and operated to perforate the wall of the wellbore at another specified interval. The perforating string is withdrawn back to the lubricator 202 and the valve assembly 10 closed to isolate the lubricator 202 from pressure in the remaining portion of the fracturing stack 200.

The valve assembly 10 is then used (as described in more detail below) to depressurize a top portion of the fracturing stack 200 for removing the lubricator 202 from the fracturing stack 200 (resulting in the configuration of FIG. 2C) and in introducing a well drop from atmospheric conditions in the environment surrounding the fracturing stack 200 into the center bore of the well 4 without needing to lower the pressure in the fracturing stack 200 below the valve assembly 10 or in the surface equipment (e.g., blenders, frack pumps, associated lines, and/or other surface equipment). The well drop can be released using a launcher (e.g., a single or multi ball, collet, dart launcher, and/or another type of launcher) on the fracturing stack 200 or by hand, manually inserting the well drop into the top of the stack 200 above the valve assembly 10. When released from the valve assembly 10, the well drop travels through the well 4, landing on a specified profile internal to the well 4 to isolate the fractured interval from the remaining portion of the well, for example, by shifting a frac sleeve or sealing off the central bore. Once the fractured interval is isolated, the next fracturing stage is begun.

Figure 3B:
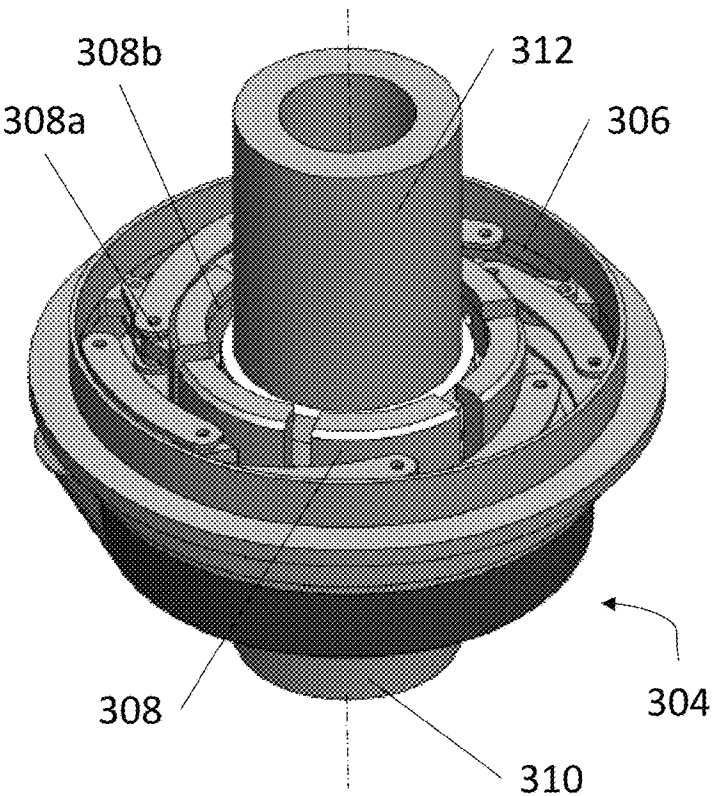
FIGS. 3A-3B are perspective views of an example connector closed (FIG. 3A) and open (FIG. 3B).
Figure 3A:
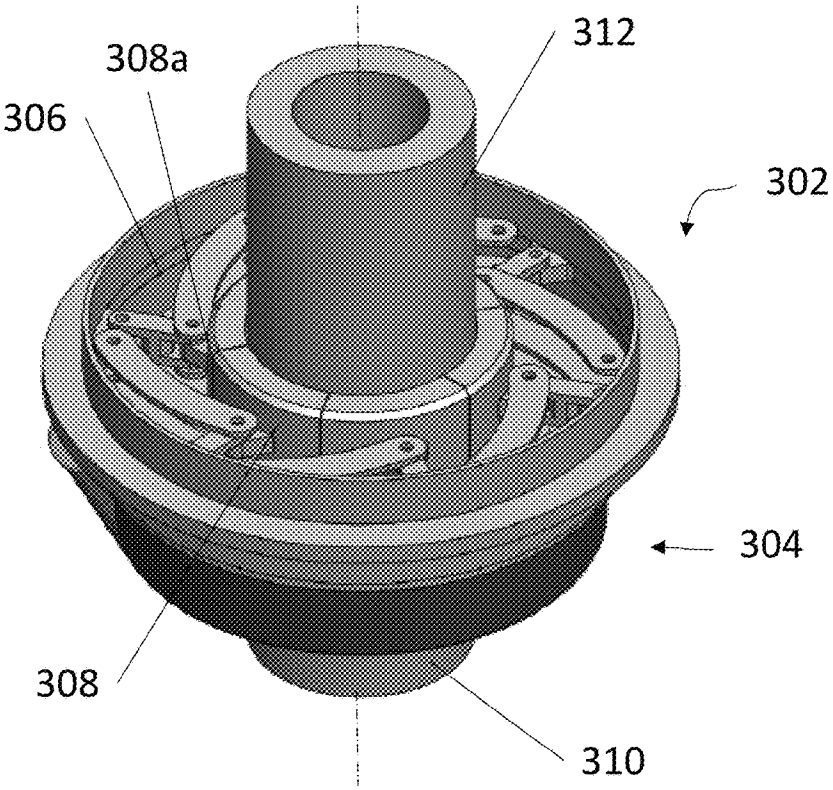

FIGS. 3A-3B are perspective views of an example connector 302, which can be used as latch 206, shown closed/engaged (FIG. 3A) and open/disengaged (FIG. 3B). The connector 302 is actuable in response to a signal (e.g., hydraulic, electric and/or other) to secure (i.e., lock) a tool to the fracturing stack 200 as well as any tools and other stack components positioned above the connector 302, such as the lubricator 202 or BOP 204. The connector 302 includes a housing 304. The housing 304 carries a drive ring 306 that is rotatable relative to the housing 304. The housing 304 receives a first well stack tool 310 and a second well stack tool 312, such that the housing is positioned around the tools 310, 312. In certain instances, the first tool 310 is the valve assembly 10, while the second tool 312 is the BOP 204, a ball or stick launcher, the wireline lubricator 202, or another well device. As illustrated, the drive ring 306 protrudes outward from an outer perimeter of the housing 304. One or more clamps 308 (six are shown—each defining an arc segment of a circle) are within the housing to clamp to the tools 310, 312. Each clamp 308 includes an attachment end 308*a* and a clamping end 308*b*. The clamp 308 is moveable between an engaged position (FIG. 3A) and a disengaged position (FIG. 3B). In the engaged position, the clamp 308 engages the second well tool 312 by the clamping end 308*b*. In the disengaged position, the clamp 308 allows the well tool to become unrestrained from the connector 302.

A linkage 402 is coupled to the drive ring 306, the housing 304, and the clamp 308. The linkage 402 is moveable between a first position supporting the clamp in the engaged position (FIG. 3A) and a second position supporting the clamp in the disengaged position (FIG. 3B). The linkage 402 is movable between the first position and the second position by rotating the drive ring 306.

Figures 4A, 4B:
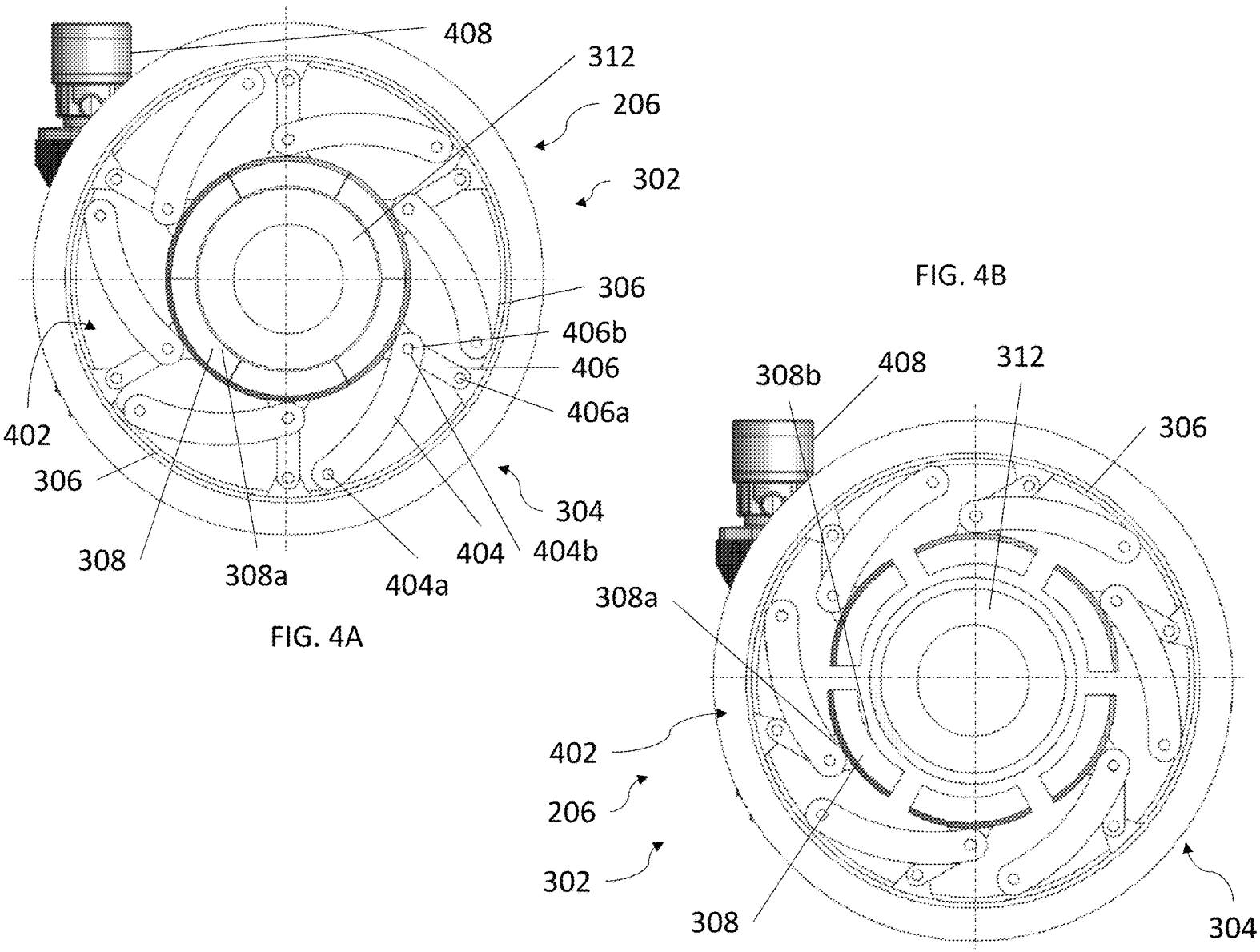
FIGS. 4A-4B are top-down views of the example connector of FIGS. 3A-3B closed (FIG. 4A) and open (FIG. 4B).

FIGS. 4A-4B are top-views of the example connector of FIGS. 3A-3B. As illustrated, the connector has multiple linkages, one for each clamp. In some implementations, additional or fewer clamps and linkages can be used. In general, the linkages are configured to move concurrently with one another. For example, the linkages 402 are shown as all being coupled to the same drive ring 306.

Each of the linkages includes a first arm 404 with a first end 404*a* and a second end 404*b*. The first end 404*a* of the first arm 404 is hingedly coupled to the housing 304. That is, the first end 404*a* of the first arm 404 has a single degree of freedom to rotate about a pivot point fixed to the housing 304. This single degree of freedom is in the same plane as the drive ring 306. A second arm 406 has a first end 406*a* and a second end 406*b*. The first end 406*a* of the second arm 406 is hingedly coupled to the drive ring 306. That is, the first end 406*a* of the second arm 406 has a single degree of freedom to rotate about a pivot point fixed to the drive ring 306. This single degree of freedom is in the same plane as the drive ring 306. The second end 406*b* of the second arm 406 is hingedly coupled to the second end 404*b* of the first arm 404. The clamp 308 is coupled to the second end 404*b* of the first arm 404 and the second end 406*b* of the second arm 406. The attachment end 308*a* of the clamp 308 is coupled to the second end 404*b* of the first arm 404 and the second end 406*b* of the second arm 406.

The drive ring 306 is coupled to an actuator 408 configured to operate in response to a signal. In some implementations, the actuator 408 is a rotary actuator. In such instance, the drive ring 306 can include multiple teeth on an outer circumference of the drive ring 306. The teeth can engage with a pinion gear on the rotary actuator 408, which the rotary actuator 408 rotates to drive rotation of the drive ring 306. In some implementations, the drive ring 306 can be coupled to a separate drive gear surrounding the first wellbore tool 310 or the second wellbore tool 312. The separate drive gear can then be coupled to the actuator 408. In some implementations, a chain drive can be used to connect the actuator gear to the drive ring or the drive gear. In some implementations, all or part of the gearing system may be retained and protected within the housing 304. In some implementations, the actuator 408 can be a linear actuator. In such an implementation, the actuator is attached directly to the drive ring 306 by a linkage, such that when the actuator 408 extends, linearly, it rotates the drive ring 306.

Figure 5:
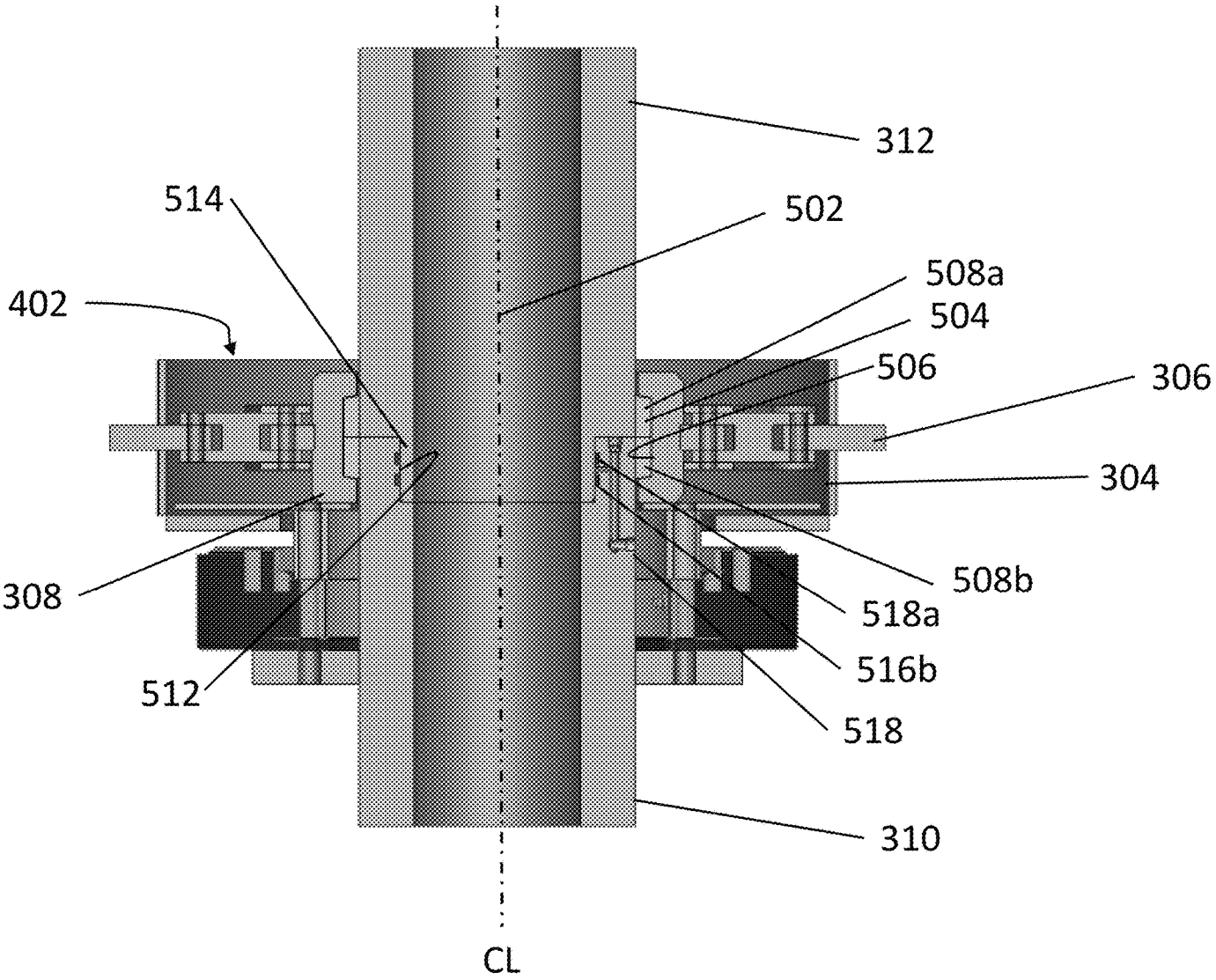
FIG. 5 is a half side cross-sectional view of the example connector of FIGS. 3A-3B in the closed position.

FIG. 5 is a side cross-sectional view of an example connector in the closed position. The first well tool 310, the second well tool 312, and the housing 304 are aligned on a common center axis 502, and the tool 312 has a male stab 514 that is received and sealed in a female receptacle 512 of tool 310 (or vice versa). FIG. 5 shows a pair of axially spaced apart seals 516*a*, 516*b* in the female receptacle 512 of the tool 310, but in other instances the seals could be provided on the tool 312. Also, the seals 516*a*, 516*b* need not be in the female receptacle 512 and could be provided on the male stab 514 (and on whichever tool has the male stab). A pressure test port 518 extends from the exterior of the bore through the tools 312, 310 to a location intermediate the seals 516*a*, 516*b*, to pressure test the sealing. In other words, fluid to supplied (e.g., pumped) into the space between the seals 516*a*, 516*b* and held at a test pressure for specified period of time, monitoring for leaks. In certain instances, the test pressure is above the pressures expected during the completion.

The drive ring 306 is rotatable about the common center axis 502. As illustrated, the first well tool 310 and the second well tool 312 have hubs 508*a*, 508*b* at their ends that form a male profile 504 when mated together and the first well tool 310 stabs into the second. The clamps 308 each have a female profile 506 shaped to receive the male profile 504. The combination of profiles allows the connector to lock the first well tool 310 and the second well tool 312 together, as the female profile 506 axially bounds the male profile 504—holding the two tools 310, 312 axially together—and the clamps 308 circumferentially enclose the male profile 504—laterally holding the two tools 310, 312 together.

In some implementations, a pressure port through a sidewall of either the first tool 310 or the second tool 312 communicates to the interior bore of the tools 310, 312. A pressure sensor connected at this pressure port can sense the pressure within the interior bore of the tools 310, 312.

Figure 6:
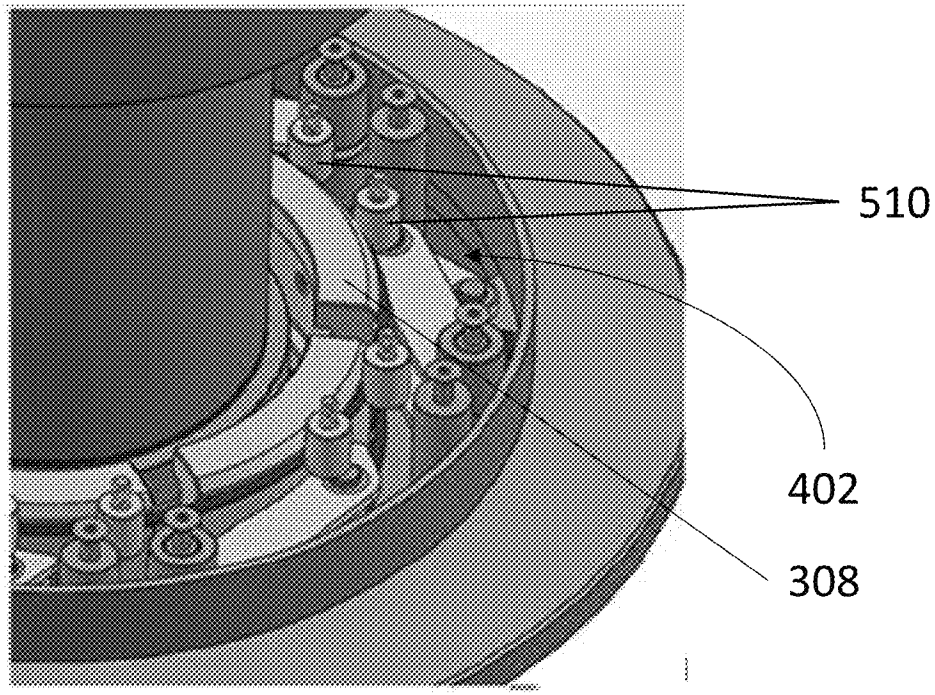
FIG. 6 is a partial perspective view of the example connector of FIGS. 3A-3B with portions removed to show soft stops.

As shown in FIG. 6, the latch 302 can include one or more bumpers or stops 510 to limit the motion of the clamps 308. The stops 510 are affixed to the housing 304 and are positioned relative to each clamp 308 such that when the clamp 308 is fully disengaged from the tools 310, 312 the clamp 308 abuts the stops 510. The stops 510 align the clamp 308 relative to the center axis 502, with the center of the clamp's arc segment being near or at the center axis 502. The stops 510 can be secured to the housing 304 in a variety of ways, such as being fastened to a top cover (not shown) of the housing 304. In some implementations, two soft stops 510 are used for each clamp, but additional or fewer stops can be used.

Figure 7:
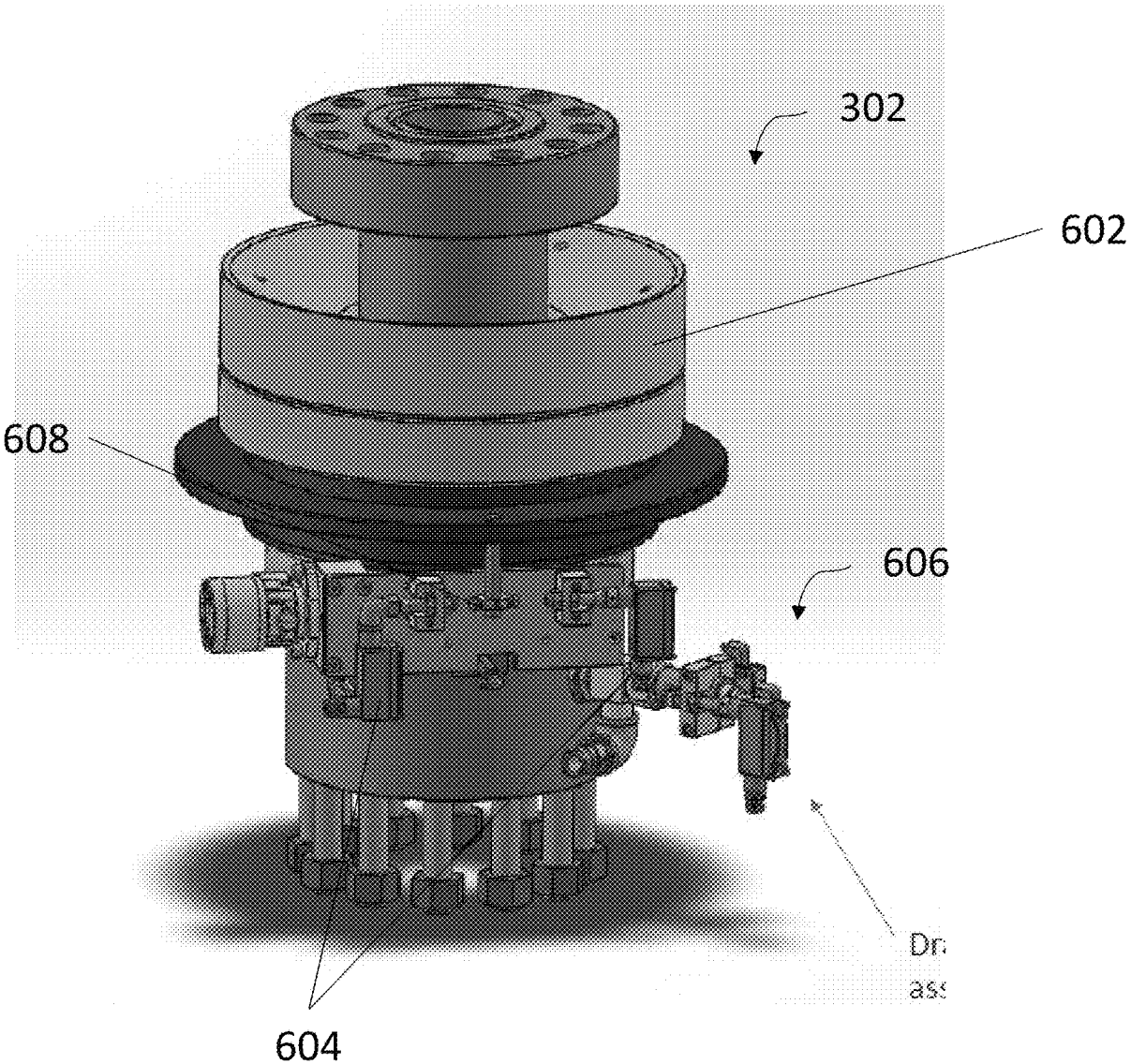
FIG. 7 is a side perspective view of the example connector of FIGS. 3A-3B.

FIG. 7 illustrates a side perspective view of the connector 302 with a top mounted guide cone 602 that funnels the second tool 312 to align on the center axis 502 as it is stabbed into the guide cone 602 and then into the first tool 310.

FIG. 7 also shows a system of proximity sensors 604 to detect the open/closed/intermediate state of the connector 302. The proximity sensors 604 are mounted on the housing 304 to sense the position of a corresponding magnet 608 affixed to the drive ring 306. When the drive ring 306 is rotated to engage the clamps to the first and second tool 310, 312, the magnet 608 is adjacent to one proximity sensor 604 and when the drive ring 306 is rotated to disengage the clamps, the magnet 608 is adjacent to the opposing proximity sensor 604. As discussed below, a controller can determine the state of the latch using the proximity sensors 604 and, in turn, operate an electronic interlock.

FIG. 7 also shows a drain assembly 606 that extends through the side of the housing 304. The drain assembly 606 protrudes into the bore of the connector 302 to be in fluid communication with the bores of the first and second tools 310, 312, and can be actuated open to drain fluid from the bore or actuated closed to seal against draining fluid. In certain instances, fluid can also be supplied (e.g., pumped) through the drain assembly 606 into the bores of the first and second tools 310, 312 to provide fluid into the bores (e.g., after the bores have been drained).

Figure 8A:
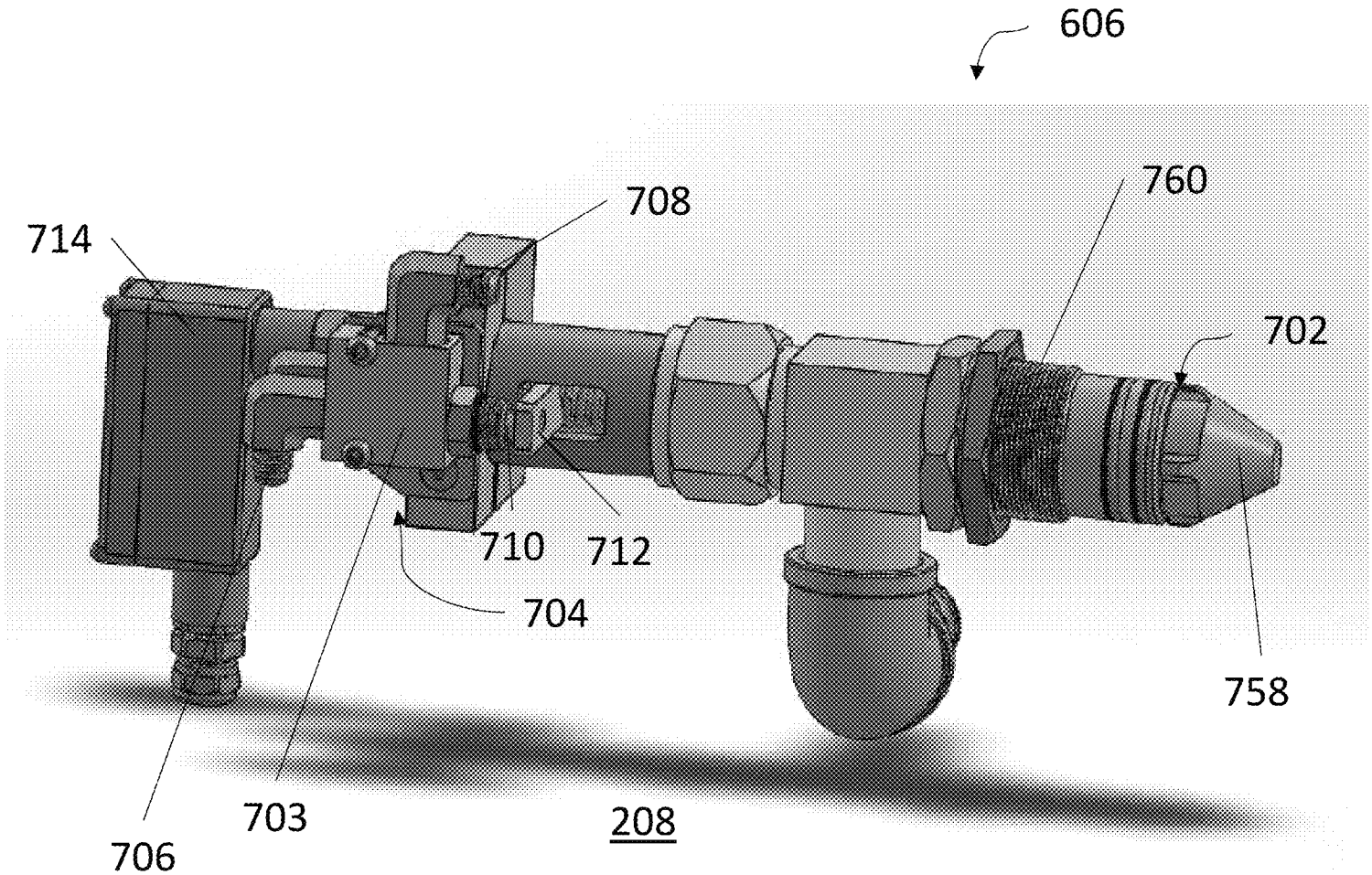
FIGS. 8A-8B is a perspective view and a half cross-sectional view, respectively, of an example drain assembly.
Figure 8B:
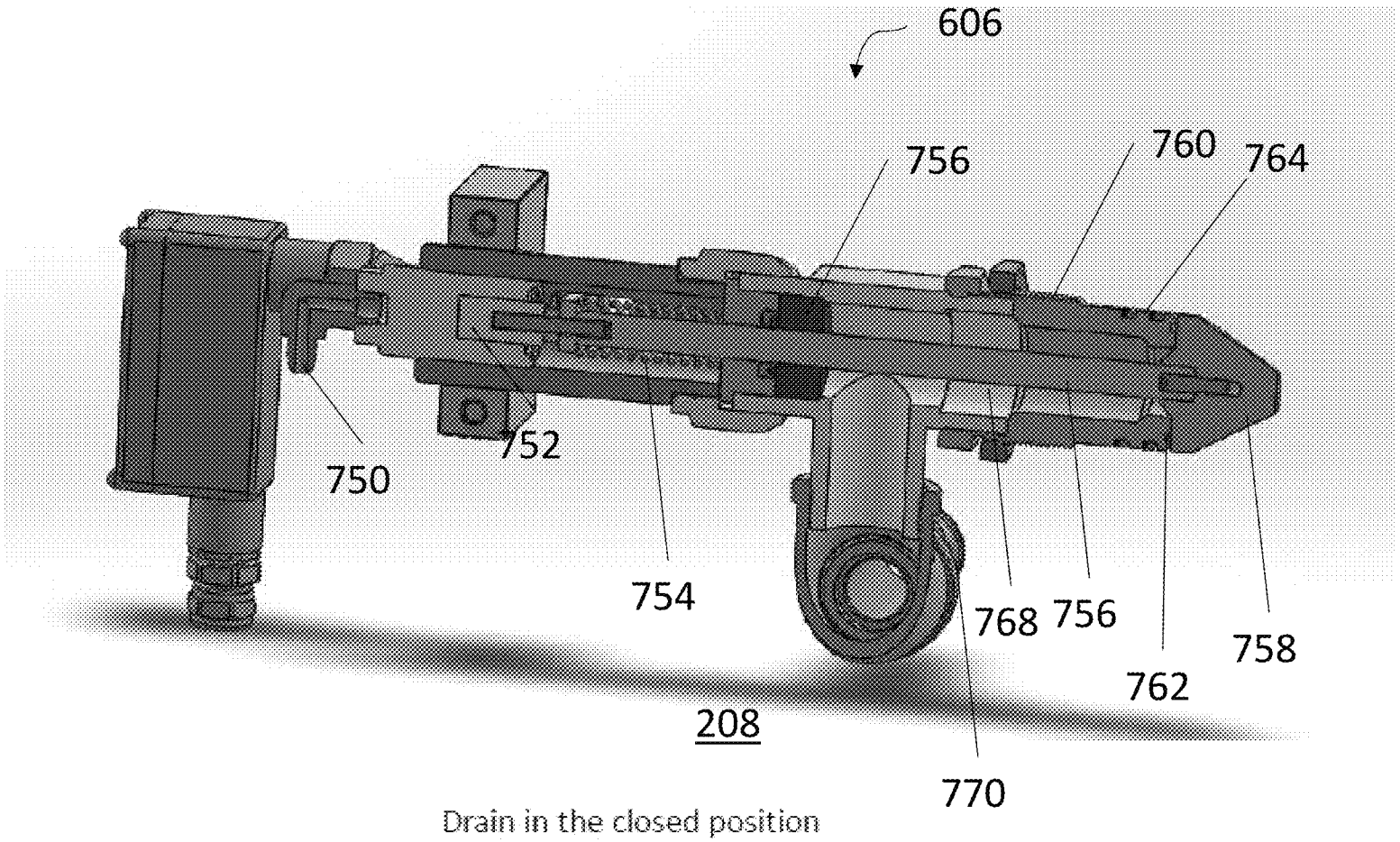

FIGS. 8A-8B are a perspective view and a half cross-sectional view, respectively, of an example drain assembly 606. The example drain assembly includes a drain valve 702 and a hydraulic interlock 704. The hydraulic interlock 704 includes a push button valve 703—a type of valve with a hydraulic input 706, a hydraulic output 708 and a valve state push button 710 that, when pushed in, opens the valve to pass fluid between the input 706 and output 708 and that, when not pushed in, seals against passage of fluid between the input 706 and output 708. In use, the valve 702 is connected between the hydraulic pump or other source that would, in other circumstances, supply hydraulic pressure to power a hydraulic-driven, drive ring actuator used to operate the connector 302. Thus, the hydraulic input 706 is connected to the output of the hydraulic pump while the hydraulic output 708 is connected to return hydraulic fluid to the pump and/or to a fluid source. A hydraulic drive ring actuator (e.g., actuator 408 of FIG. 4A) is connected to the output of the hydraulic pump to receive pressure from the pump. The valve state button 710 interacts with a tab 712 on the drain valve 702. When the drain valve 702 is in a closed position, the tab 712 abuts and presses against the valve state button 710. The pressure applied by the tab 712 on the valve state button 710, pushes the button 710 in and puts the valve in an open state. In the open state, hydraulic fluid is allowed to pass from the input 706 to output 708, bypassing the drive ring actuator. In this state, the actuator for the drive ring receives no significant pressure from the pump and the connector 302 is locked out and cannot operate to open. When the drain valve 702 is in an open position, the tab 712 is moved from the valve state button. The valve state button 710 is allowed to protrude outward, and the valve 703 moves to a closed state. In the closed state, hydraulic fluid cannot pass between input 706 and output 708, thus directing all of the pump pressure onward to drive the drive ring actuator. In this state, the actuator for the drive ring is able to receive hydraulic pressure and can be operated to open. In some implementations, an electrical proximity sensor 714 can be included to signal a state of the drain valve 702, the hydraulic interlock 704, or both.

Referring to FIG. 8B, the operation of the drain valve 702 is described. An end portion of the drain valve 702 is inserted through an aperture in the sidewall of the housing 304 of connector 302, so that a plunger 758 of the valve 702 is in the bore of the housing. The outer surface of the drain valve 702 has seals 764 that seal to the inner diameter of the aperture, sealing the drain valve 702 to the housing. The drain valve 702 is secured to the housing 304 with threads 760. When the drain valve 702 is in a closed position (as illustrated), the plunger rests on a seat 762. The seat 762 seals against passage of fluid into an interior cavity 768 of the valve 702. The seat 762 can be a metal-to-metal seat, an elastomer seat, or another type of seat. When the drain valve 702 is in an open position, the plunger 758 is moved apart from the seat 762 by the valve stem 756. Separating the plunger 758 from the seat 762 allows fluid to flow from the central bore of the housing 304, through the cavity 768 to an outlet 770. The movement of the valve stem 756 to open/close the plunger 758 is controlled by an actuator. In FIG. 8B, the actuator is a hydraulic actuator that includes a pressure inlet 750 configured to be connected to a hydraulic source, such as the hydraulic pump connected to the valve of the interlock 704 or another source, and which itself may have a control valve to gate pressure to the inlet 750. The pressure inlet 750 is fluidically connected to a spring-loaded piston 752 affixed to the valve stem 756. When pressure is applied through the inlet 750, it acts on the piston 752 driving it toward the right in FIG. 8B. The piston 752, in turn, also drives the valve stem 756 to the right, opening the valve 702 by moving the plunger 758 off the seat 762. The spring-loaded piston is biased to the left in FIG. 8B, so as to cause the valve 702 to "fail closed." That is, when there is no hydraulic pressure at the pressure inlet 750, the spring 754 of the spring-loaded piston 752 will force the drain valve 702 into the closed position shown in FIG. 8B.

Although described with the hydraulic interlock above, other configurations are possible. For example, the hydraulic interlock can be actuated when the drain valve 702 is moved to the open position. In another example, the connector 302 can be alternatively or additionally implemented with an electronic interlock. For example, a controller (e.g., controller 51) can monitor pressure in the central bore (e.g., via a pressure sensor in port 508 or elsewhere). If pressure above a threshold pressure is sensed in the bore, the controller can refuse to actuate the connector 302 to open (e.g., refuse to signal actuator 408 to operate) until the pressure drops below the threshold pressure.

Figure 9:
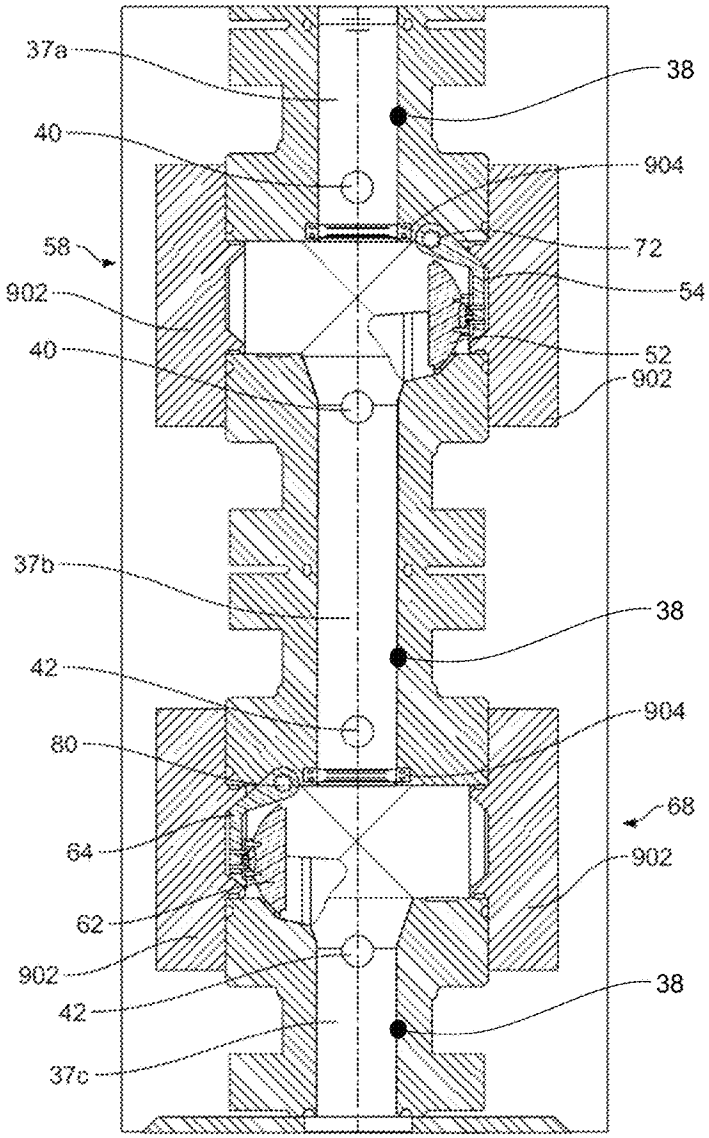
FIG. 9 is a half cross-sectional view of the example valve assembly.

Turning now to FIG. 9, FIG. 9 is an example side cross-sectional view of an example valve assembly 10. It includes a first valve body 58 coupled to a second valve body 68 by a flanged connection. However, in other instances, the valve bodies could be coupled by another type of connection or could be formed as a single, integral one piece unit. The top and bottom of the valve assembly 10 are also flanged to facilitate connecting the valve assembly 10 in-line in the fracturing stack, but other types of connections could be used.

In this example, the valve assembly 10 is a full bore valve. In other words, the main, central bore through the valve is the same diameter, without intruding obstructions, as the main, central bore through the remainder of the fracturing stack, so that tooling can pass easily through the valve assembly 10 without obstruction.

In the illustrated implementation, the first actuator rod 72 and the second actuator rod 80 are positioned outside of the center bore of the valve assembly. This arrangement enables the flappers 52, 62 and their corresponding pivot arms 54, 64 to retract into corresponding side cavities of the valve assembly 10 when the flappers are open, so as to reside completely out of the center bore when open. In this implementation, the first rod 72 and the second rod 80 are directly connected to the first pivot arm 54 and the second pivot arm 64, respectively. The direct connection further provides a compact configuration that facilitates containment of the flappers 52, 62 and pivot arms 54, 64 out of the bore. For ease of construction and maintenance, the valve assembly 10 can include side openings capped by blind flanges 902 sealed and affixed to the valve bodies 58, 68. The blind flanges 902 can be installed and removed easily to facilitate access to the flappers 52, 62 and pivot arms 54, 64 during construction or maintenance. Pressure sensors 38 can be provided in fluid communication with the operating volumes for measuring the pressure in each operating volume, as well as the pressure differential between operating volumes. Additional or fewer sensors could be provided, as well as sensors of different types.

Metal seals 904 are retained to the valve bodies 58, 68, and form a metal-to-metal seal between the valve bodies 58, 68 and their respective flappers 52, 62 when the flappers are closed. Also, in certain instances, the flappers 52, 62 are coupled to their respective pivot arms 54, 64 in a compliant manner, to allow movement between the flapper and arm. The movement facilitates the flappers 52, 62 seating on the seals 904 as they close.

The valve assembly 10 includes a first, or top, operating volume 37*a* near an upper end of the assembly 10 that can be isolated from the remainder of the valve assembly 10 to enable the volume 37*a* to be maintained at a lower pressure (e.g., atmospheric pressure) than the remainder of the valve assembly 10. The first operating volume 37*a* can thus be in fluid communication with whatever is disposed above it via an opening at the top end of the central bore through the valve assembly 10.

The valve assembly 10 further includes a second intermediate, or load lock, operating volume 37*b* disposed adjacent to the first operating volume 37*a*. A third, or bottom, operating volume 37*c* is disposed adjacent to a second operating volume 37*b* on an opposite side of the second operating volume 37*b* from the first operating volume 37*a*. Each operating volume 37*a*, 37*b*, and/or 37*c* can be sealed from the others to contain fluid at different pressures.

The valve assembly 10 is designed to use the fluid pressure in the third operating volume 37*c* to pressurize the second operating volume 37*b* and the pressure in the second operating volume 37*b* to pressurize the first operating volume 37*a*. The valve assembly 10 is also designed to reduce pressure of the second operating volume 37*b* by bleeding to the atmosphere or to the first operating volume 37*a*.

The valve assembly 10 further includes a first passage 40 that selectively communicates the first operating volume 37*a* with the second operating volume 37*b* and a second passage 42 that selectively communicates the second operating volume 37*b* with the third operating volume 37*c*. Each of the passages 40, 42 have an actable valve that are actuable to close to seal the passages or to open to allow the passages to pass fluid. The first operating volume 37*a* can be a space that is defined by the area between the first flapper 52 and any tool disposed atop the valve assembly 10. To pass a well drop (e.g., a frac ball, collet, soap or other item to be dropped into the well) through the valve assembly 10, the pressure of the fluid in the second operating volume 37*b* is adjusted to be within a specified maximum pressure differential from the fluid in the first operating volume 37*a*. Adjusting the pressure of the fluid in the second operating volume 37*b* allows the first flapper 52 to open up and permit the well drop disposed in the first operating volume 37*a* to pass into the second operating volume 37*b*. The second operating volume 37*b* can be sized such that the well drop can be contained therein without affecting the operation of the first flapper 52. For example, the second operating volume 37*b* could be smaller when the well drop is a frac ball and it would be larger (taller/longer) if the well drop was a collet.

When the pressure of the fluid in the second operating volume 37*b* is beyond the specified maximum pressure differential from the fluid in the first operating volume 37*a*, the first flapper 52 cannot be opened by operation of the valve assembly 10. In certain instances, the maximum pressure differential is implemented in the operation of system, for example, by the configuration (e.g., strength or other characteristic) of the valve actuator, hydraulic areas, by control interlocks coupled with pressure sensors on either side of first flapper 52 (to measure pressure in the first and second operating volumes 37*a*, 37*b*) or in another manner, and specified to prevent unintentional opening of the first flapper 52, damage to the valve assembly 10 and other nearby equipment, and/or an otherwise unsafe condition.

To pass the well drop from the second operating volume 37*b* into the third operating volume 37*c*, the pressure of the fluid in the second operating volume 37*b* is increased to be within a specified maximum pressure differential from the fluid in the third operating volume 37*c*. Once the pressure of the fluid in the second operating volume 37*b* is within the specified maximum pressure differential from the fluid in the third operating volume 37*c*, the second flapper 62 will open and permit the well drop to pass from the second operating volume 37*b* into the third operating volume 37*c*.

Similar to operation of the first flapper 52, when the pressure of the fluid in the third operating volume 37*c* is outside of the specified maximum pressure differential from the fluid in the second operating volume 37*b*, the second flapper 62 cannot be opened by the operation of the valve assembly 10. As above, the specified maximum pressure differential used with the second flapper 62 can be implemented, for example, by the configuration (e.g., strength or other characteristic) of the valve actuator, hydraulic areas, by control interlocks coupled with pressure sensors measuring on either side of second flapper 62 (to measure pressure in the second and third operating volumes 37*b*, 37*c*) or in another manner, and specified to prevent unintentional opening of the second flapper 62, damage to the valve assembly 10 and other nearby equipment, and/or an otherwise unsafe condition. Also, the specified maximum pressure differential used with the first flapper 52 and second flapper 62 need not be the same. Logic can be built into a controller that controls the operation of the first flapper 52 and second flapper 62, which prevents the opening of the first flapper 52 and the second flapper 62 if the pressure across either flapper 52, 62 is beyond its respective specified maximum differential.

To run a tool on wireline or tubing through the valve assembly 10 during operating conditions (i.e., high-pressure conditions), the first flapper 52 and the second flapper 62 must be in an open position simultaneously. For the first flapper 52 and the second flapper 62 to be open, the pressure of the fluid in the first operating volume 37*a* and the second operating volume 37*b* can be adjusted to be within the specified maximum pressure differential with the pressure of the fluid in the third operating volume 37*c*. This allows the first flapper 52 and the second flapper 62 to open up and permit the tool to pass through the valve assembly 10. In certain instances, the first flapper 52 and the second flapper 62 can be a type of valve that cannot shear the wireline or tubing during operation, such as flapper valves and the like. Other valves, such as plug valves, gate valves, and ball valves can be used with appropriate interlocks to prevent sheering of the wireline or tubing. That is, the first flapper 52 and the second flapper 62 can be any type of valve that can make contact with the tool or its conveyance without damaging it.

In some implementations, when wanting to pass a tool through the valve assembly 10, the first flapper 52 is in a closed position and the pressure of the fluid in the second operating volume 37*b* can be increased to be within the specified maximum pressure differential with the fluid in the third operating volume 37*c*, so the second flapper 62 can open. In this scenario, the pressure of the fluid in the first operating volume 37*a* will then be increased to be within the specified maximum pressure differential with the fluid in the second operating volume 37*b*, so the first flapper 52 can open. The pressure of the fluid in the first operating volume 37*a* will dictate the pressure in the fracturing stack above, since the two are in fluid communication. Once the first flapper 52 and the second flapper 62 are open, the tool is permitted to pass all of the operating volumes and into the well.

In some instances, the first flapper 52 is in an open position and the second flapper 62 is in a closed position when it is desirable for the valve assembly 10 to be used in passing a tool. The fluid in the first operating volume 37*a* and the second operating volume 37*b* is increased within the specified maximum pressure differential with the fluid in the third operating volume 37*c*, the second flapper 62 can open, which would permit the tool to be extended into and through the valve assembly 10. Conversely, the second flapper 62 can be in an open position and the first flapper 52 is in a closed position when it is desirable for the valve assembly 10 to be used in passing a tool. In this instance, the fluid in the first operating volume 37*a* is increased within the specified maximum pressure differential with the fluid in the second operating volume 37*b*, and the third operating volume 37*c*, the first flapper 52 can open, which permits the tool to be extended into and through the valve assembly 10. It should be understood and appreciated that each operating volume 37*a*, 37*b*, and/or 37*c* can be pressured up or down in numerous ways.

In certain situations, the pressure of the fluid in the third operating volume 37*c*, because it is exposed to well conditions, is dynamic and may be fluctuating in such a manner whereby the fluid pressure in the second operating volume 37*b* cannot reach the substantially same pressure as the dynamic pressure of the fluid in the third operating volume 37*c* for a sufficient amount of time to open the second flapper 62. In some implementations, to combat this dynamic fluid pressure issue, the valve assembly 10 can include an external pump in fluid communication with the second operating volume 37*b* to increase the pressure of the fluid in the second operating volume 37*b* to a sufficient pressure to overcome the dynamic pressure of the fluid in the third operating volume 37*c* for a sufficient amount of time and permit the second flapper 62 to open. The external pump 48 can be any type of pump capable of achieving the required fluid pressures, for example, a triplex plunger pump or a diaphragm pump.

The valve assembly 10 can include a first port disposed in the body of the valve assembly 10 that fluidically connects the third operating volume 37*c* with a first end of a first equalizing passage 42. The first passage 42 extends from the first port to a second port disposed in the body of the valve assembly 10 that fluidically connects the second operating volume 37*b* to a second end of the first passage 42. The valve assembly 10 can also include a third port disposed in the body of the valve assembly 10 that fluidically connects the second operating volume 37*b* with a first end of a second equalizing passage 42. The second passage 40 extends from the third port to a fourth port disposed in the body of the valve assembly 10 that fluidically connects the first operating volume 37*a* to a second end of the second passage 40. In some implementations, the valve assembly 10 can include a third conduit that fluidically connects the third operating volume 37*c* to the first operating volume 37*a*. The first operating volume 37*a* and third operating volume 37*c* can include additional ports to facilitate this fluid connection or the third conduit can be tied into the first passage 42 on one end, where the first passage 42 comes out of the third operating volume 37*c* and ties into the second passage 40 on the other end, where the second passage 40 comes out of the first operating volume 37*a*. Equalizing valves (e.g., sealing valve, flow diverters, and/or other fluid flow control devices) can be incorporated into or in fluid communication with the conduits direct fluid to flow to the appropriate conduits to accomplish the desired operation of the valve assembly 10. The equalizing valves can be actuable types, actuable to open/close in response to a signal (e.g., hydraulic, electric and/or other) and can include multiple devices for redundancy and safety.

To manage the pressure of the fluid in the second operating volume 37*b*, the first passage 42 that fluidically connects the second operating volume 37*b* to the third operating volume 37*c* can be used to increase the pressure of the fluid in the second operating volume 37*b*. The associated valve can be activated to permit the fluid at a higher pressure in the third operating volume 37*c* to flow into the second operating volume 37*b* in order to increase the pressure of the fluid in the second operating volume 37*b* via the first passage 42. The second passage 40 that fluidically connects the second operating volume 37*b* to the first containment can be used to increase the pressure of the fluid in the first operating volume 37*a* or decrease the pressure of the fluid in the second operating volume 37*b*. In some implementations, the associated valve can be activated to permit the fluid at a higher pressure in the second operating volume 37*b* to flow into the first operating volume 37*a* in order to increase the pressure of the fluid in the first operating volume 37*a*. In some implementations, the associated valve can be activated to permit the fluid at a higher pressure in the second operating volume 37*b* to flow into the first operating volume 37*a* in order to decrease the pressure of the fluid in the second operating volume 37*b* via the first passage 42.

The valve assembly 10 can also include a first vent fluidically connected to the first operating volume 37*a* to bleed pressure from the first operating volume 37*a* when it is desirable to decrease the pressure of the fluid therein. The valve assembly 10 can also include a second vent fluidically connected to the second operating volume 37*b* to bleed pressure from the second operating volume 37*b*. The first vent can be a separate port in fluid communication with the first operating volume 37*a*. In another implementation, the first vent can use the fourth port disposed in the body of the valve assembly 10, the second passage 40 or third conduit, and any appropriate valves, flow diverters, fluid flow control devices, and the like to bleed pressure from the first operating volume 37*a*. The second vent can be a separate port in fluid communication with the second operating volume 37*b*. In another implementation, the second vent can use the second port or the third port disposed in the body of the valve assembly 10, the first passage 42 or second passage 40, and any appropriate valves, flow diverters, fluid flow control devices, and the like to bleed pressure from the second operating volume 37*b*.

In one implementation, the second operating volume 37*b* can be positioned below the first operating volume 37*a* and the third operating volume 37*c* can be positioned below the second operating volume 37*b*. This orientation allows the well drop being passed through the valve assembly 10 or the tool to pass downward through the valve assembly 10.

In one implementation, the first flapper 52 and second flapper 62 can be flapper valves, oriented to open into the second and third operating volumes 37*b*, 37*c*, so the higher pressure of the fluid in the second operating volume 37*b* over the pressure of the fluid in the first operating volume 37*a* acts on the flapper to maintain the closure of the first flapper 52 and the higher pressure of the fluid in the third operating volume 37*c* over the pressure of the fluid in the second operating volume 37*b* acts on the flapper to maintain the closure of the second flapper 62. Further, the first flapper 52 and second flapper 62 can be opened and closed by an actuator, one on each flapper, that is responsive to signals (e.g., electric, hydraulic or other). The actuator 50 can be any type of actuator 50 known in the art. Examples include, but are not limited to, a pneumatic actuator, a hydraulic actuator, an electrical actuator, an air-over hydraulic actuator, a manual screw actuator, or manual lever actuator. The first flapper 52 and the second flapper 62 can be driven by a single actuator or multiple actuators. The actuators can be controlled by the controller 51.

In some implementations, the valve assembly 10 is designed to not destroy the wireline or tubing that are in the valve assembly 10 during operation, even by an accidental activation of the first flapper 52 and/or the second flapper 62. The valve assembly 10 is designed so that the first flapper 52 must fully close before the second flapper 62 will close. If the first flapper 52 does not fully close, then the second flapper 62 will not close. The first flapper 52 can be designed such that it will close at a predetermined speed or force and will continue to close unless the first flapper 52 meets some form of resistance before the first flapper 52 is completely closed. If the tool string is running through the valve assembly 10, then the first flapper 52 will contact it, which provides resistance to the first flapper 52 prior to the first flapper 52 being fully closed, but not contact it with such force that the wireline or tubing is destroyed or damaged (e.g., severed). The operation above can be implemented via control logic in the controller 51 and/or by physical configuration of the valve assembly 10 (e.g., by sizing of the valve actuators and hydraulic areas or by providing a slip clutch between each valve and its actuator). In some implementations, the controller 51 can receive signals from various sensors and create an interlock if an object is detected by the sensors. Such an interlock prevents the actuators from moving and potentially damaging the wireline, tubing or tool string. Sensors can include optical sensors, position sensors, current sensors, torque sensors, or any other type of sensor that can be used to determine the presence of an obstruction, such as the wireline, tubing or tool string. For example, in some implementations, current sensors can be provided on the actuators. A larger than normal current draw during actuation (i.e., above a specified threshold current) can indicate that there is an object within the valve assembly 10. The actuator 50 can then feed that data back to the controller 51, which can deactivate the actuator 50 in response to the data. In other examples, similar results can be achieved with torque sensors on the actuators (e.g., when torque to move the flappers is above a specified threshold torque) or pressure sensors on hydraulic lines of the actuators (e.g., pressure to move flappers with a hydraulic actuator is above a specified threshold pressure).

In some implementations, the position of the actuator 50 for the first flapper 52 and/or second flapper 62 can be monitored to determine where resistance begins for the first flapper 52 and/or second flapper 62. The actuator 50 for the first flapper 52 and/or second flapper 62 can also have a lower force to close the valves so that if resistance occurs before the first flapper 52 and/or second flapper 62 is completely closed, the actuator 50 will stop forcing the first flapper 52 and/or the second flapper 62 to close. The valve assembly 10 may also be equipped with an indicator to notify an operator that the first flapper 52 and/or second flapper 62 could not close, which alerts the operator that the tool string is in the valve assembly 10. This also prevents the other valve from closing and damaging the tool string. Feedback from the first flapper 52 and/or the second flapper 62 or the actuator 50 controlling the first flapper 52 and/or the second flapper 62 can be connected mechanically or electronically.

When it is desirable to pass the well drop through the valve assembly 10, the well drop is delivered into the first operating volume 37*a*. To pass the well drop from the first operating volume 37*a* to the second operating volume 37*b*, pressure of the fluid in the second operating volume 37*b* has to be decreased (or potentially increased in certain circumstances) to essentially the same pressure as the pressure of the fluid in the first operating volume 37*a* (the low pressure area). To facilitate this, the equalizing valve is manipulated to permit fluid from the second operating volume 37*b* to flow through the second passage 40 and into the first operating volume 37*a*. Permitting fluid to flow through the second passage 40 from the second operating volume 37*b* into the first operating volume 37*a* results in the pressure of the fluid in the second operating volume 37*b* being decreased to substantially the same pressure as the pressure of the fluid in the first operating volume 37*a*. During the operation, permitting the well drop to flow from the first operating volume 37*a* into the second operating volume 37*b*, the second flapper 62 is in the closed position.

When it is desirable for the well drop to flow from the second operating volume 37*b* to the third operating volume 37*c*, pressure of the fluid in the second operating volume 37*b* has to be increased to essentially the same pressure as the pressure in the fluid in the third operating volume 37*c* (the high-pressure system). To facilitate this, the appropriate equalizing valve is manipulated to permit fluid from the third operating volume 37*c* to flow through the first passage 42 and to the second operating volume 37*b*. Permitting fluid to flow through the first passage 42 from the third operating volume 37*c* into the second operating volume 37*b* results in the pressure of the fluid in the second operating volume 37*b* being increased to substantially the same pressure as the pressure of the fluid in the third operating volume 37*c*. During the operation, permitting the well drop to flow from the second operating volume 37*b* into the third operating volume 37*c*, the first flapper 52 is in the closed position.

Figure 10:
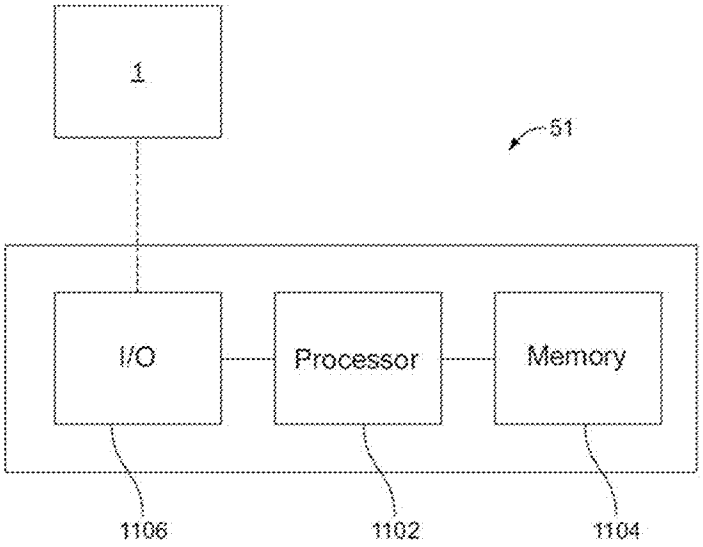
FIG. 10 is a block diagram of a controller that can be used with aspects of this disclosure.

As shown in FIG. 10, the valve assembly 10 can include a controller 51 to, among other things, monitor pressures of the operating volumes and send signals to actuate the equalizing valves 44 and the actuators 50. As shown in FIG. 10, the controller 51 can include a processor 1102 (implemented as one or more local or distributed processors) and non-transitory storage media (e.g., memory 1104—implemented as one or more local or distributed memories) containing instructions that cause the processor 1102 to perform the methods described herein. The processor 1102 is coupled to an input/output (I/O) interface 1106 for sending and receiving communications with other equipment of the well fracking site 1 (FIG. 1), including, for example, the actuator 408 and/or other actuators (e.g., valve actuators). In certain instances, the controller 51 can additionally communicate status with and send actuation and control signals to one or more of the automated latch 206 (for example, connector 302), the other valves (including main valves 216 and swab valve 212) of the fracturing stack 200, the BOP 204, the lubricator 202 (and its tool trap), any well drop launcher, as well as other sensors (e.g., pressure sensors, temperature sensors and other types of sensors) provided in the fracturing stack 200. In certain instances, the controller 51 can communicate status and send actuation and control signals to one or more of the systems on the well site 1, including the blenders 3, fracking pumps 5 and other equipment on the well site 1. The communications can be hardwired, wireless or a combination of wired and wireless. In some implementations, the controller 51 can be located on the valve assembly 10. In some implementations, the controller 51 can be located elsewhere, such as in the data van 6, elsewhere on the well site 1 or even remote from the well site 1. In some implementations, the controller can be a distributed controller with different portions located about the well site 1 or off site. For example, in certain instances, a portion of the controller 51 can be located at the valve assembly 10, while another portion of the controller 51 can be located at the data van 6 (FIG. 1).

The controller 51 can operate in monitoring, controlling, and using the valve assembly 10 for introducing a well drop and for allowing the passage of a tool through the valve assembly 10 to the high pressure area. To monitor and control the valve assembly 10, the controller 51 is used in conjunction with transducers (sensors) to measure the pressure of fluid at various positions in the valve assembly 10 and to measure the position of various parts of the valve assembly 10. Input and output signals, including the data from the transducers, controlled and monitored by the controller 51, can be logged continuously by the controller 51.

Figure 11:
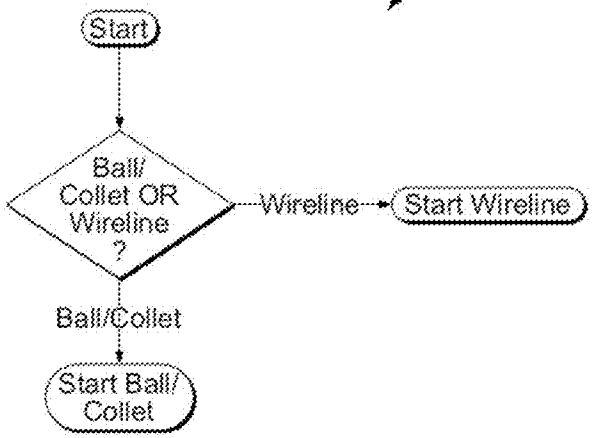
FIG. 11 is an example logic diagram that can be executed by the example controller.

Once the valve assembly 10 is powered up, a determination is made whether a wireline deployed tool sequence is desired or a well drop sequence is desired. The wireline deployed tool sequence would be used when a tool on wireline, such as perforating string or logging string supported on wireline, is passed through the fracking stack 200 into the well 4. A well dropping sequence would be used when a well drop (e.g., frac ball, collet, soap bar or other) is to be dropped through the fracking stack 200 into the well 4. FIG. 11 shows an example logic sequence 1100 that is used by the controller to set which operation to perform. The determination is made based on user input to the controller, for example, through a terminal in communication with the controller. In the event that a wireline deployed tool sequence is desired, then logic sequence 1200 is selected. Notably, the wireline sequence can also be used for running tubing deployed tools. If a well drop sequence is desired, then a logic sequence 1300 is selected. Details of each logic sequence are provided below. The logic sequences 1100, 1200 and 1300 can be stored as executable instructions in the memory 1004 of controller 51.

Figure 12:
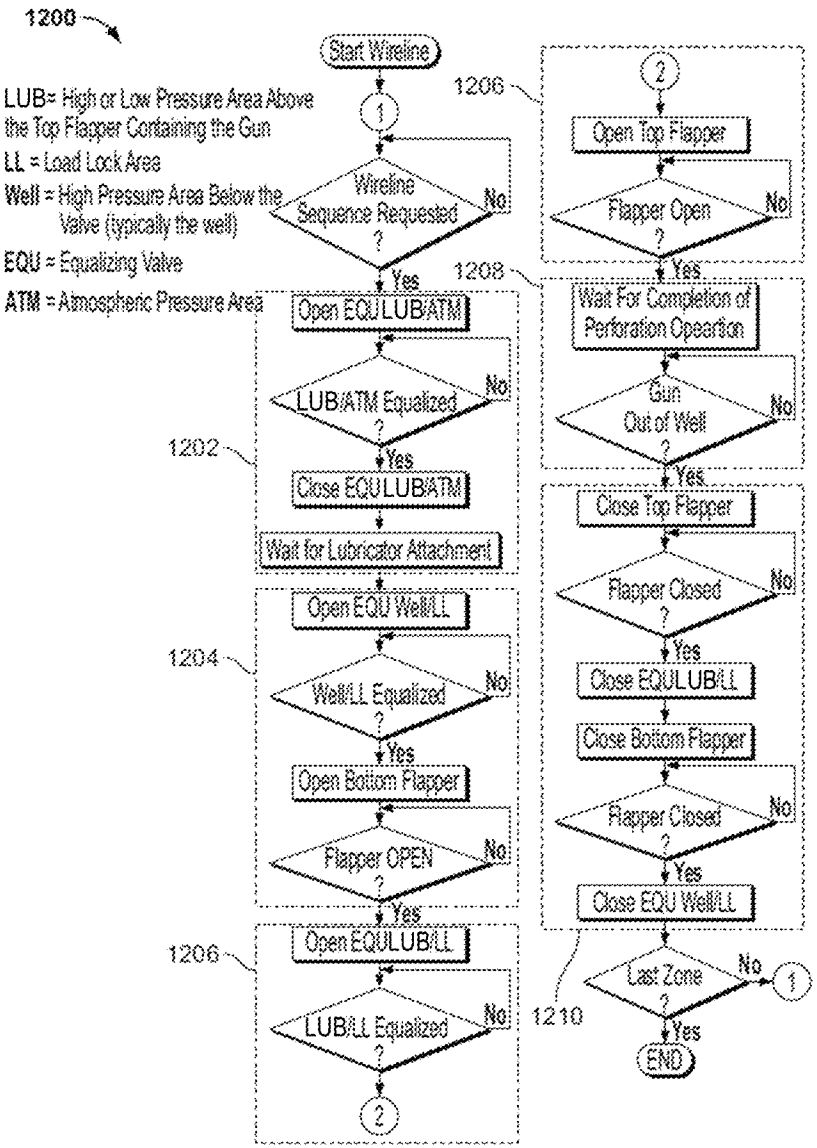
FIG. 12 is an example logic diagram that can be executed by the example controller.

FIG. 12 is a block diagram of an example logic sequence 1200 that can be used by the controller 51 (FIG. 51) when executing wireline operations. In performing the wireline sequence, a lubricator containing the wireline tool string typically has previously been attached above the valve assembly (FIG. 2A). The sequence 1200 can be performed autonomously, without human intervention other than to indicate to the controller 51 that certain actions performed apart from controller 51 (e.g., stabbing/retrieving the lubricator) have been completed. At operation 1201, a check of the lubricator is performed. That is, the controller 51 makes a determination if the lubricator is present. Such a check can be performed using the sensing port 508. If the lubricator is not present, the controller 51 can issue an alert and/or an interlock to prevent the sequence from continuing until the lubricator is present. The lubricator can be lifted onto the well stack 200 and secured to the stack with the latch 206 (e.g., connector 302, discussed above). In such an instance, the controller 51 can actuate the latch 206 to transition to the disengaged position so that it may accept the lubricator. Once the lubricator is on the stack, the controller can actuate the latch 206 to the engaged position to secure the lubricator to the well stack 200.

If the lubricator needs to be installed or removed, for example to change or repair the tool carried in the lubricator, operation 1202 is performed. In operation 1202, the pressure of the fluid in the first operating volume 37*a* (FIG. 9) is brought to atmospheric pressure (e.g., absolute atmospheric pressure, actual pressure of the surrounding atmosphere, or to within a specified maximum pressure differential to either). The pressure of the fluid in the first operating volume 37*a* can be determined via a pressure sensor in fluid communication with the first operating volume 37*a* and coupled to the controller 51. The pressure of the fluid in the first operating volume 37*a* can be reduced by venting the first operating volume 37*a* (e.g., by actuating an equalizing valve, as described above (i.e., Open EQU LUB/ATM)) to bleed off pressure. Once it is verified that the pressure of the fluid in the first operating volume 37*a* is equalized with the atmosphere (i.e., LUB/ATM Equalized), the latch 206 can be actuated to disengage the lubricator form the well stack 200. The lubricator can then be changed or accessed, and the lubricator reinstalled to the fracking stack 200 by securing the lubricator with the latch 206. Actuating the latch 206 can be done autonomously via control logic within the controller 51 and/or manually by an operator. Notably, the pressure in the well 4 and the fracking stack 200 below the valve assembly 10 need not be affected, and can remain at fracturing pressure or near to fracturing pressure.

In operation 1204, the second flapper 62 is operated. First, the pressure of fluid in the second operating volume 37*b* (referred to as the "load lock area" in the accompanying diagram) can be determined via a pressure sensor in fluid communication with the second operating volume 37*b*. To open the second flapper 62 that separates the second operating volume 37*b* and the third operating volume 37*c*, the pressure of the fluid in the second operating volume 37*b* has to be within the specified maximum pressure differential to the third operating volume 37*c*, which essentially equalizes the second operating volume 37*b* and third operating volume 37*c*. The third operating volume 37*c* is open to the well 4, and thus is at well pressure. If the pressure differential is greater than the specified maximum pressure differential, the pressure of the fluid in the second operating volume 37*b* has to be increased to be essentially equal (i.e., within the specified maximum pressure differential wherein the second flapper 62 will open) to the pressure of the fluid in the third operating volume 37*c*.

To increase the pressure of the fluid in the second operating volume 37*b*, the equalizing valve associated with the first passage 42 connecting the second operating volume 37*b* and the third operating volume 37*c* can be opened, i.e., actuated, and the pressure of the fluid in the third operating volume 37*c* flows into the second operating volume 37*b* and increases the pressure of the fluid in the second operating volume 37*b* to the specified maximum pressure differential of the fluid in the third operating volume 37*c* (i.e., Open EQU Well/LL). Once the pressure of the fluids in the second operating volume 37*b* and the third operating volume 37*c* are equalized (i.e., Well/LL Equalized?), the second flapper 62 separating these two operating volumes can be opened (i.e., Open Bottom Flapper). Once actuated, the system can check to confirm the flapper 62 is opened (i.e., Flapper OPEN?)

Once the second flapper 62 separating the second operating volume 37*b* and the third operating volume 37*c* is opened, the first flapper 52 will need to be opened to allow the tool string to be extended through the valve assembly 10 (operation 1206). To open the first flapper 52, the pressure of the fluid in the first operating volume 37*a* and the second operating volume 37*b* is brought to within the specified maximum pressure differential wherein the first flapper 52 is capable of opening. If the pressure of the fluid in the second operating volume 37*b* is greater than the pressure of the fluid in the first operating volume 37*a*, the pressure of the fluid in the first operating volume 37*a* has to be increased to be essentially equal (or within a certain range wherein the first flapper 52 will open) to the pressure of the fluid in the second operating volume 37*b*. In another implementation, the pressure of the fluid in first operating volume 37*a*, the second operating volume 37*b*, and the third operating volume 37*c* can be brought to within a certain range and the first flapper 52 and second flapper 62 can then be opened. The first and second flapper 52 and 62 can be opened at the same time, or near the same time, to permit the tool string to extend through the valve assembly 10 and into the well.

To increase the pressure of the fluid in the first operating volume 37*a*, the equalizing valve associated with the second passage 40 connecting the first operating volume 37*a* and the second operating volume 37*b* can be opened, i.e., actuated, and the pressure of the fluid in the second operating volume 37*b* flows into the first operating volume 37*a* and increases the pressure of the fluid in the first operating volume 37*a* to be essentially equal to the pressure of the fluid in the second operating volume 37*b* (i.e., Open EQU LUB/LL). Once the pressure of the fluids in the first operating volume and the second operating volume 37*b* are equalized (i.e., LUB/LL Equalized?), the first flapper 52 separating the first operating volume 37*a* and the second operating volume 37*b* can be opened (i.e., Open Top Flapper). Once actuated, the system can check to confirm the flapper 52 is opened (i.e., Flapper OPEN?) In certain implementations, a third conduit fluidically connecting the first operating volume 37*a* and the third operating volume 37*c*, and a corresponding equalizing valve could be used to permit the fluid in the third operating volume 37*c* be used to increase the pressure of the fluid in the first operating volume 37*a*.

It should be understood that for wireline sequences, the second flapper 62 separating the second operating volume 37*b* and the third operating volume 37*c* can be started out as open and left open for the duration of the operation to equalize the pressure of the fluid in the valve assembly 10.

Once the second flapper 62 separating the second operating volume 37*b* and the third operating volume 37*c* and the first flapper 52 are opened, the fluid in the valve assembly 10 is equalized and the lubricator can feed the tool string into and through the valve assembly 10 to perform any desired operation in the well (operation 1208). After the conclusion of the operation being performed via the tool string (i.e., Wait For Completion of Perforation Operation), the tool string can be withdrawn from the well and the valve assembly 10 (i.e., Gun Out of Well?). In operation 1210, the first flapper 52 can then be closed (i.e., Close Top Flapper, Flapper Closed?) and the equalizing valve associated with the second or third conduit, depending on which conduit was used to equalize the first operating volume 37*a*, can be closed (i.e., Close EQU LUB/LL). The second flapper 62 separating the second operating volume 37*b* and the third operating volume 37*c* can then be closed (i.e., Close Bottom Flapper, Flapper Closed?). The equalizing valve associated with the first equalizing passage 42 can be closed after the second flapper 62 is closed (i.e., Close EQU Well/LL).

The opening and closing of the first flapper 52 that separates the first operating volume 37*a* and second operating volume 37*b* and the second flapper 62 that separates the second operating volume 37*b* and third operating volume 37*c* can be verified via a valve position sensor (can be the same valve position sensor or separate valve position sensors) in communication with the controller.

The process can be repeated. If no other operations are to be performed, the wireline sequence is terminated (i.e., Last Zone?). If the wireline sequence is terminated, the pressure of the fluid in the first operating volume 37*a* can be decreased to atmospheric pressure venting the first operating volume 37*a* to bleed pressure from the first containment.

Figure 13:
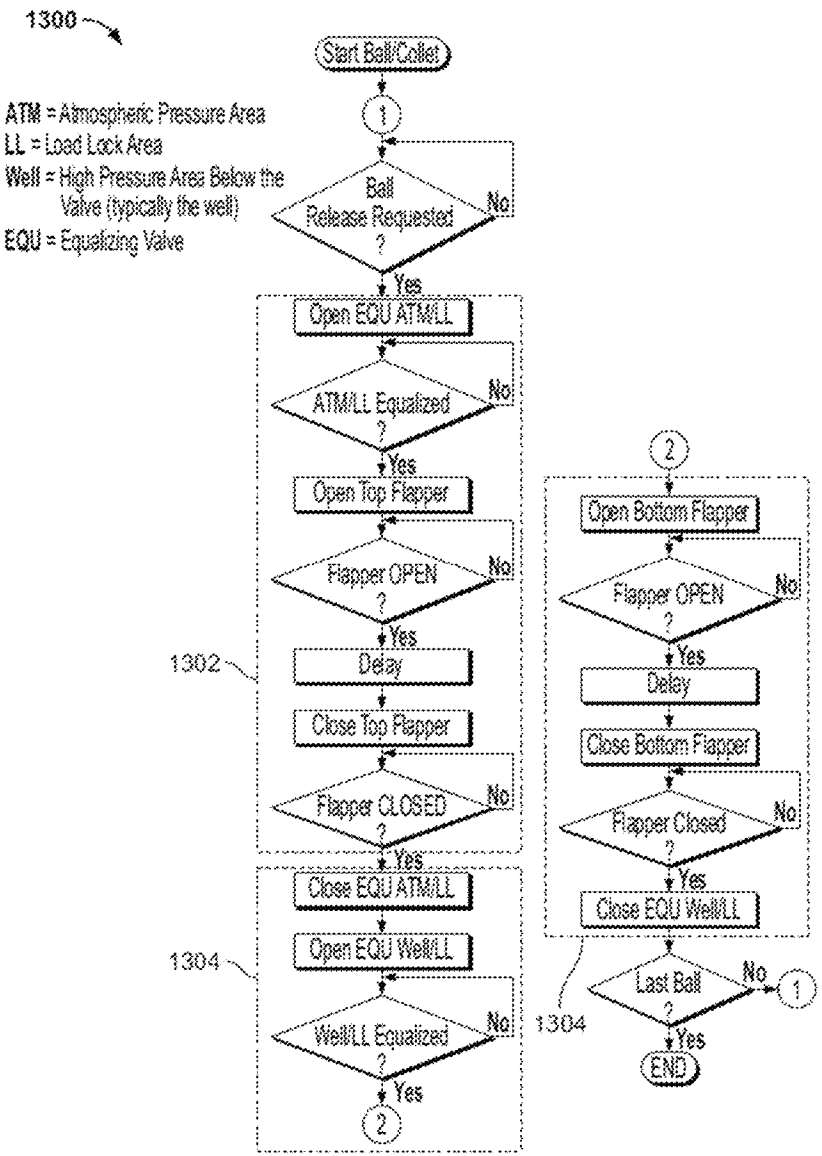
FIG. 13 is an example logic diagram that can be executed by the example controller.

FIG. 13 is a block diagram of an example logic sequence 1300 that can be used by the controller 51 to execute well drop operations, for example, dropping a frac ball or collet down the well. As with sequence 1200, sequence 1300 can be performed autonomously, without human intervention other than to indicate to the controller 51 that certain actions performed apart from controller 51 (e.g., placing the well drop) have been completed. In general, if logic sequence 1300 is used, operation 1301 is performed. That is, a check of the launcher, such as a ball or collet launcher, is performed. The controller 51 makes a determination if the launcher is present. Such a determination can be made using sensing port 508. If the launcher is not present, the controller 51 can issue an alert and/or an interlock to prevent the sequence from continuing until the launcher is present. The launcher can be lifted onto the well stack 200 and secured to the stack with the latch 206 (e.g., connector 302). In such an instance, the controller 51 can actuate the latch 206 to transition to the disengaged position so that it may accept the launcher. Once the launcher is on the stack, the controller can actuate the latch 206 to the engaged position to secure the launcher to the well stack 200.

Once it is determined the launcher is secured to the well stack, the valve assembly 10 is given the command via the controller to continue the logic sequence 1300. When it is desirable to conduct the logic sequence 1300, the well drop to be released will be positioned in the first operating volume 37*a* and operation 1302 performed. To open the first flapper 52, the pressure of the fluid in the second operating volume 37*b* has to be within a certain range of the pressure of the fluid in the first operating volume 37*a*, which essentially equalizes the first and second operating volumes 37*a* and 37*b*. The pressure of the fluid in the first operating volume 37*a* can be determined via a pressure sensor if the pressure of the fluid is not known to be atmospheric. Pressure of the fluid in the second operating volume 37*b* can be determined via a pressure sensor coupled to the second operating volume 37*b*.

The pressure of the fluid in the second operating volume 37*b* can be reduced by opening the corresponding equalizing valve to the second passage 40 that fluidically connects the second operating volume 37*b* and the first operating volume 37*a*. Once the pressure of the fluid in the first operating volume 37*a* and the second operating volume 37*b* equalizes, the first flapper 52 can then be opened by the controller 51. The controller 51 will not send the signal to open the first flapper 52 until the equalization occurs between the first operating volume 37*a* and the second operating volume 37*b*. The equalizing valve can remain open until the equalization occurs and then be closed before or during the opening of the first flapper 52 or the vent port or second passage 40 can remain open during the opening and closing of the first flapper 52.

The well drop will fall from the first operating volume 37*a* into the second operating volume 37*b* once the first flapper 52 is opened. Confirmation of the well drop having fallen into the second operating volume 37*b* can be verified by a well drop detection sensor that can confirm the presence of the well drop in the second operating volume 37*b*. After a specified amount of time (delay) or detection of the well drop in the second operating volume 37*b*, the first flapper 52 will close. The closure of the first flapper 52 can be verified via a valve position sensor in communication with the controller 51. Once it has been verified that the first flapper 52 has been closed, the vent port or the second passage 40 can be closed if the vent port or the second passage 40 was left open during the operation of the first flapper 52.

The well drop to be released is then passed into the third operating volume 37*c* (operation 1304). Pressure of fluid in the third operating volume 37*c* can be determined via a pressure sensor coupled to the third operating volume 37*c*. To open the second flapper 62, the pressure of the fluid in the third operating volume 37*c* has to be within a certain range of the pressure of the fluid in the second operating volume 37*b*, which essentially equalizes the second operating volume 37*b* and the third operating volume 37*c*. The pressure of the fluid in the second operating volume 37*b* can be determined via the pressure sensor used to determine the pressure of the fluid in the second operating volume 37*b*.

The pressure of the fluid in the second operating volume 37*b* can be increased by opening the first passage 42 via the equalizing valve associated with the first passage 42. The first passage 42, when opened, allows the pressure of the fluid in the third operating volume 37*c* to flow there through and increase the pressure of the fluid in the second operating volume 37*b*. Once the pressure of the fluid in the second and third operating volumes 37*b* and equalizes, the second flapper 62 can then be opened by the controller. The controller will not send the signal to open the second flapper 62 until the equalization occurs between the second operating volume 37*b* and the third operating volume 37*c*. The first passage 42 can remain open until the equalization occurs and then be closed before or during the opening of the second flapper 62 or the first passage 42 can remain open during the opening and closing of the second flapper 62.

The well drop will fall from the second operating volume 37*b* into the third operating volume 37*c* once the second flapper 62 is opened. Confirmation of the well drop having fallen into the third operating volume 37*c* can be verified by the well drop detection sensor disclosed herein or a separate well drop detection sensor that can determine the location of the well drop in the third operating volume 37*c*. After a certain amount of time or detection of the well drop in the third operating volume 37*c*, the second flapper 62 will close. The closure of the second flapper 62 can be verified via a valve position sensor (can be the same valve position sensor disclosed herein or a separate valve position sensor) in communication with the controller 51. Once it has been verified that the second flapper 62 has been closed, the first passage 42 can be closed if the first passage 42 was left open during the operation of the second flapper 62.

After the well drop is passed into the third operating volume 37*c* (or well), a determination of whether another well drop will be passed into the third operating volume 37*c* is made. If no further well drop is to be passed into the third operating volume 37*c*, the logic sequence 1300 is terminated. If an additional well drop is to be passed into the third operating volume 37*c*, another well drop is positioned in the first operating volume 37*a* and the logic sequence 1300 is recommenced.

A number of implementations have been described. Nevertheless, it will be understood that various modifications may be made. Accordingly, other implementations are within the scope of the following claims.

What is claimed is:

1. A well stack connector for coupling, above a wellhead, a first well device in a well stack and a second well device, the connector comprising:

a housing;

a drive ring carried by the housing and rotatable relative to the housing;

a clamp within the housing, the clamp moveable between an engaged position and a disengaged position where, in the engaged position, the clamp engages the first well device to the second well device and, in the disengaged position, the clamp allows the first well device to become unrestrained from the second well device; and a linkage coupled to the drive ring, the housing and the clamp, the linkage moveable, by rotation of the drive ring, between a first position supporting the clamp in the engaged position and a second position supporting the clamp in the disengaged position.

2. The well stack connector of claim 1, wherein the clamp comprises an attachment end opposite a clamping end, wherein the clamp is a first clamp and the linkage is a first linkage, the connector further comprising:

a second clamp within the housing, the clamp comprising an attachment end opposite a clamping end, where, in the engaged position, the clamp engages, by the clamping end, the first well device to the second well device and in the disengaged position the clamp allows the first well device to become unrestrained from the second well device; and a second linkage coupled to the drive ring, the housing and the second clamp, the linkage moveable between a first position supporting the second clamp in the engaged position and a second position supporting the second clamp in the disengaged position, the second linkage movable between the first position and the second position concurrently with the first linkage by rotating the drive ring.

3. The well stack connector of claim 1, wherein the linkage comprises:

a first arm coupled to the housing and the clamp; and a second arm coupled to the drive ring and proximate to the coupling of the first arm to the clamp.

4. The well stack connector of claim 3, wherein the second arm is coupled to the first arm proximate to the coupling of the first arm to the clamp.

5. The well stack connector of claim 1, wherein the first well device, the second well device, and the housing reside on a common center axis, the drive ring being rotatable about the common center axis.

6. The well stack connector of claim 1, wherein the first well device and the second well device form a male profile when mated together, the clamp comprising a female profile shaped to internally receive and clamp the male profile.

7. The well stack connector of claim 1, further comprising a plurality of teeth on an outer circumference of the drive ring; and a rotary actuator comprising a gear that engages the teeth.

8. The well stack connector of claim 1, wherein the housing internally receives the first well device and the second well device, and the drive ring protrudes outward from an outer perimeter of the housing.

9. The well stack connector of claim 1, comprising:

a hydraulic actuator coupled to drive the drive ring;

a drain valve changeable between a closed state sealing a passage into a bore of the first or second well device and an open state, with the passage open to allow fluid therethrough; and an interlock valve operatively coupled to the drain valve, the interlock valve configured to bypass hydraulic pressure from the hydraulic actuator when the drain valve is in the closed state and not bypass hydraulic pressure from the hydraulic actuator when the drain valve is in the open state.

10. A method comprising:

in response to rotating a drive ring of a connector residing above a wellhead, engaging a clamp to interface with a first well device in a well stack and a second well device, wherein engaging the clamp comprises actuating a linkage coupling the drive ring to the clamp, the linkage arranged to move the clamp radially in response to rotating the drive ring; and clamping the first well device to the second well device with the clamp.

11. The method of claim 10, further comprising axially retaining the first well device to the second well device with the clamp.

12. The method of claim 10, further comprising radially retaining the first well device to the second well device with the clamp.

13. A method comprising:

in response to rotating a drive ring of a connector residing above a wellhead, engaging a clamp to interface with a first well device in a well stack and a second well device, wherein rotating the drive ring comprises rotating the drive ring with a geared actuator coupled to the drive ring; and clamping the first well device to the second well device with the clamp.

14. A method comprising:

in response to rotating a drive ring of a connector residing above a wellhead, engaging a clamp to interface with a first well device in a well stack and a second well device, testing a seal of the first well device to the second well device by supplying pressure to a seal between the first well device and the second well device, the pressure supplied from a pump outside well devices; and clamping the first well device to the second well device with the clamp.

15. A well stack comprising:

a fracturing head;

a valve assembly above the fracturing head, the valve assembly having two separately actuable valves; and a connector above the valve assembly configured to receive a well tool, the connector actuable to engage the well tool to or disengage the well tool from a remainder of a well string by rotating a drive ring of the connector in response to a signal from an operator.

16. The well stack of claim 15, wherein the connector comprises:

a housing carrying the drive ring; and a clamp within the housing, the clamp comprising an attachment end and a clamping end, the clamp moveable between an engaged position and a disengaged position where in the engaged position the clamp engages, by the clamping end, the well tool and in the disengaged position the clamp allows the well tool to become unrestrained from the connector; and a linkage coupled to the drive ring, the housing and the clamp, the linkage moveable between a first position supporting the clamp in the engaged position and a second position supporting the clamp in the disengaged position, the linkage movable between the first position and the second position by rotating the drive ring.

17. The well stack of claim 16, wherein the linkage comprises:

a first arm coupled to the housing and the clamp; and a second arm coupled to the drive ring and proximate to the coupling of the first arm to the clamp.

18. The well stack of claim 17, wherein the second arm is coupled to the first arm proximate to the coupling of the first arm to the clamp.

19. The well stack of claim 15, wherein the well tool is at least one of a blowout preventer, a ball or stick launcher, or a wireline lubricator.

20. The well stack of claim 15, wherein the valve assembly comprises:

a body defining a central bore;

a first valve actuable to seal the central bore;

a second valve actuable to seal the central bore;

a first passage between a volume of the center bore above the first valve and the volume of the center bore between the first and second valves; and a second passage between the volume of the center bore between the first and second valves and a volume of the center bore below the second valve.

* * * * *